US009971300B2

(12) United States Patent
Moon et al.

(10) Patent No.: US 9,971,300 B2
(45) Date of Patent: May 15, 2018

(54) CARTRIDGE AND ELECTROPHOTOGRAPHIC IMAGE FORMING APPARATUS INCLUDING THE SAME

(71) Applicant: S-PRINTING SOLUTION CO., LTD., Suwon-si, Gyeonggi-do (KR)

(72) Inventors: Ji-won Moon, Anyang-si (KR); Joon-hee Kim, Seoul (KR); Sang-hoon Lee, Suwon-si (KR)

(73) Assignee: S-PRINTING SOLUTION CO., LTD., Suwon-si (KR)

( * ) Notice: Subject to any disclaimer, the term of this patent is extended or adjusted under 35 U.S.C. 154(b) by 0 days. days.

(21) Appl. No.: 15/354,306

(22) Filed: Nov. 17, 2016

(65) Prior Publication Data

US 2017/0146950 A1 May 25, 2017

(30) Foreign Application Priority Data

Nov. 24, 2015 (KR) ..... 10-2015-0164838

(51) Int. Cl.
*G03G 21/18* (2006.01)
*G03G 21/16* (2006.01)

(52) U.S. Cl.
CPC ..... *G03G 21/186* (2013.01); *G03G 21/1647* (2013.01)

(58) Field of Classification Search
None
See application file for complete search history.

(56) References Cited

U.S. PATENT DOCUMENTS

| | | | | |
|---|---|---|---|---|
| 6,035,159 | A | 3/2000 | Azuma et al. | |
| 8,135,304 | B2 | 3/2012 | Abe et al. | |
| 8,615,184 | B2 | 12/2013 | Zhou et al. | |
| 2013/0272753 | A1 | 10/2013 | Fukasawa et al. | |
| 2014/0227003 | A1 | 8/2014 | Okabe | |
| 2015/0093150 | A1* | 4/2015 | Xiao | F16D 3/18 399/167 |

OTHER PUBLICATIONS

European Search Report dated Apr. 7, 2017 in corresponding European Application No. 16 20 0097.

* cited by examiner

*Primary Examiner* — Thomas Giampaolo, II
(74) *Attorney, Agent, or Firm* — Staas & Halsey LLP

(57) ABSTRACT

A cartridge detachably attachable to a main body of an image forming apparatus is provided. The cartridge includes a rotary member and a cartridge coupler. The cartridge coupler includes a transmission member coupled to a rotation axis of the rotary member, a receiving member connected to a set coupler provided in the main body for transmission of power, and a connection member connecting the transmission member and the receiving member together. The receiving member has an Oldham structure allowing movement relative to the transmission member in an axial direction. The receiving member is movable to a first position at which a rotation axis of the receiving member is misaligned with a rotation axis of the transmission member in an attachment or detachment direction, and to a second position at which the rotation axis of the receiving member is aligned with the rotation axis of the transmission member.

15 Claims, 27 Drawing Sheets

CARTRIDGE AND ELECTROPHOTOGRAPHIC IMAGE FORMING APPARATUS INCLUDING THE SAME

CROSS-REFERENCE TO RELATED APPLICATIONS

This application claims the priority benefit of Korean Patent Application No. 10-2015-0164838, filed on Nov. 24, 2015, in the Korean Intellectual Property Office, the disclosure of which is incorporated herein in its entirety by reference.

BACKGROUND

1. Field

The present disclosure relates to an image forming apparatus configured to form images on recording media by an electrophotographic method, and a cartridge detachably attachable to the image forming apparatus.

2. Description of the Related Art

Electrophotographic image forming apparatuses are used to print images on recording media by supplying toner to an electrostatic latent image formed on a photoconductor to form a visible toner image on the photoconductor, transferring the toner image to a recording medium, and fusing the transferred toner image on the recording medium.

Developing devices are each an assembly of components for forming visible toner images. Such a developing device is a consumable item that is attached to a main body of an image forming apparatus and replaced with a new one after use. After a developing device is attached to a main body of an image forming apparatus, rotary members of the developing device receive power from the main body.

Developing devices may have various structures. For example, developing devices may have an integral cartridge structure in which a toner container and a developing roller configured to supply toner to a photoconductor are formed integrally with the photoconductor; a compartmental structure in which an imaging cartridge including a photoconductor and a developing roller, and a toner cartridge containing toner are individually provided; or a compartmental structure in which a photoconductor cartridge including a photoconductor, a developing cartridge including a developing roller, and a toner cartridge containing toner are individually provided.

In order to drive rotary members of a cartridge, the cartridge may include a cartridge coupler, and a main body of an image forming apparatus may include a set coupler configured to make power connection with the cartridge coupler when the cartridge is attached to the main body.

SUMMARY

Additional aspects and/or advantages will be set forth in part in the description which follows and, in part, will be apparent from the description, or may be learned by practice of the invention.

Provided are a cartridge allowing stable power connection between a set coupler and a cartridge coupler, and an electrophotographic image forming apparatus including the cartridge.

Additional aspects will be set forth in part in the description which follows and, in part, will be apparent from the description, or may be learned by practice of the presented embodiments.

According to an aspect of an embodiment, a cartridge detachably attachable to a main body of an image forming apparatus includes: a rotary member; and a cartridge coupler including a transmission member coupled to a rotation axis of the rotary member, a receiving member connected to a set coupler provided in the main body for transmission of power therebetween, and a connection member connecting the transmission member and the receiving member to each other, the receiving member being movable relative to the transmission member in an axial direction, wherein the receiving member is movable to a first position at which a rotation axis of the receiving member is misaligned with a rotation axis of the transmission member in an attachment or detachment direction of the cartridge, and is movable to a second position at which the rotation axis of the receiving member is aligned with the rotation axis of the transmission member.

When the receiving member is at the first position, the receiving member may be adjacent to the transmission member, and when the receiving member is at the second position, the receiving member may be separate from the transmission member in the axial direction so that the receiving member may be connected to the set coupler provided in the main body.

The cartridge may further include an elastic member applying elastic force to move the receiving member in a direction toward the first position.

The cartridge may further include a holder supporting the receiving member while allowing rotation of the receiving member, wherein the holder may be movable to place the receiving member at the first position or the second position.

The cartridge may further include: a first guide part provided on the holder; and a second guide part configured to guide the first guide part to move the receiving member to the first position or the second position.

The holder may include an interference part, and when the cartridge is attached to the main body, the interference part may interfere with a position switch member provided on the main body so as to move the receiving member from the first position to the second position.

The cartridge may further include a first magnetic member, wherein when the cartridge is attached to the main body, the receiving member may be moved from the first position to the second position by magnetic attractive force between the first magnetic member and a second magnetic member provided in the main body.

The rotary member may include a photoconductive drum.

The cartridge may further include a developing roller configured to supply toner to an electrostatic latent image formed on the photoconductive drum.

The cartridge may further include a toner container in which the toner is contained.

According to an aspect of another embodiment, an electrophotographic image forming apparatus includes: a main body; a set coupler provided in the main body; and a cartridge detachably attachable to the main body, wherein the cartridge includes: a rotary member; and a cartridge coupler including a transmission member coupled to a rotation axis of the rotary member, a receiving member connected to the set coupler provided in the main body for transmission of power therebetween, and a connection member connecting the transmission member and the receiving member to each other, the receiving member being movable relative to the transmission member in an axial direction, wherein when the cartridge is detached from the main body, the receiving member is placed at a first position at which a rotation axis of the receiving member is misaligned with a rotation axis of the transmission member in an attachment or detachment direction of the cartridge, and when the cartridge is attached to the main body, the receiving member is moved to a second position in the axial direction such that the rotation axis of the receiving member is aligned with the rotation axis of the transmission member and the receiving member is connected to the set coupler.

The electrophotographic image forming apparatus may further include an elastic member applying elastic force to move the receiving member in a direction toward the first position.

The electrophotographic image forming apparatus may further include: a holder supporting the receiving member while allowing rotation of the receiving member, the holder being provided on the cartridge and movable to the first position and the second position; an interference part provided on the holder; and a position switch member provided on the main body and configured to move the holder from the first position to the second position by interfering with the interference part when the cartridge may be attached to the main body.

When the rotation axis of the receiving member is aligned with the rotation axis of the set coupler while the cartridge is attached to the main body, the interference part and the position switch member may start to interfere with each other.

The electrophotographic image forming apparatus may further include: a holder supporting the receiving member while allowing rotation of the receiving member, the holder being provided on the cartridge and movable to the first position and the second position; a first magnetic member provided on the holder; and a second magnetic member configured to move the holder from the first position to the second position by magnetic attractive force between the first magnetic member and the second magnetic member when the cartridge may be attached to the main body.

The set coupler provided in the main body may be movable to a connection position at which the set coupler is connected to the receiving member placed at the second position, and may be movable to a disconnection position at which the set coupler is disconnected from the receiving member.

The electrophotographic image forming apparatus may further include: a first elastic member applying elastic force to move the receiving member in a direction toward the first position; a holder supporting the receiving member and allowing the receiving member to move to the first position and the second position, the holder including a second interference part; a second position switch member provided on the main body to restrict movement of the holder in the attachment direction by interfering with the second interference part when the cartridge is attached to the main body; a set holder supporting the set coupler and allowing the set coupler to move to the connection position and the disconnection position, the set holder including a first interference part; a second elastic member applying elastic force to move the set coupler in a direction toward the disconnection position; and a first position switch member provided on the cartridge and configured to move the set holder from the disconnection position to the connection position by interfering with the first interference part when the cartridge is attached to the main body.

When the receiving member and the set coupler are aligned with each other while the cartridge is attached to the main body, the first interference part and the first position switch member may start to interfere with each other, and the second interference part and the second position switch member may start to interfere with each other.

According to an aspect of another embodiment, an electrophotographic image forming apparatus includes: a main body; a cartridge detachably attachable to the main body, the cartridge including a cartridge coupler; and a set coupler including a rotatable transmission member, a driving member connected to the cartridge coupler for transmission of power therebetween, and a connection member connecting the transmission member and the driving member to each other, the driving member being movable relative to the transmission member in an axial direction, wherein when the cartridge is detached from the main body, the driving member is placed at a first position at which a rotation axis of the driving member is misaligned with a rotation axis of the transmission member in an attachment or detachment direction, and when the cartridge is attached to the main body, the driving member is moved to a second position in the axial direction such that the rotation axis of the driving member is aligned with the rotation axis of the transmission member and the driving member is connected to the cartridge coupler.

The electrophotographic image forming apparatus may further include an elastic member applying elastic force to move the driving member in a direction toward the first position.

The electrophotographic image forming apparatus may further include: a holder supporting the driving member while allowing rotation of the driving member, the holder being provided on the main body and movable to the first position and the second position; an interference part provided on the holder; and a position switch member provided on the cartridge and configured to move the holder from the first position to the second position by interfering with the interference part when the cartridge may be attached to the main body.

When the rotation axis of the driving member is aligned with a rotation axis of the cartridge coupler while the cartridge is attached to the main body, the interference part and the position switch member may start to interfere with each other.

BRIEF DESCRIPTION OF THE DRAWINGS

These and/or other aspects and advantages will become apparent and more readily appreciated from the following description of the embodiments, taken in conjunction with the accompanying drawings.

DETAILED DESCRIPTION

Figure 1:
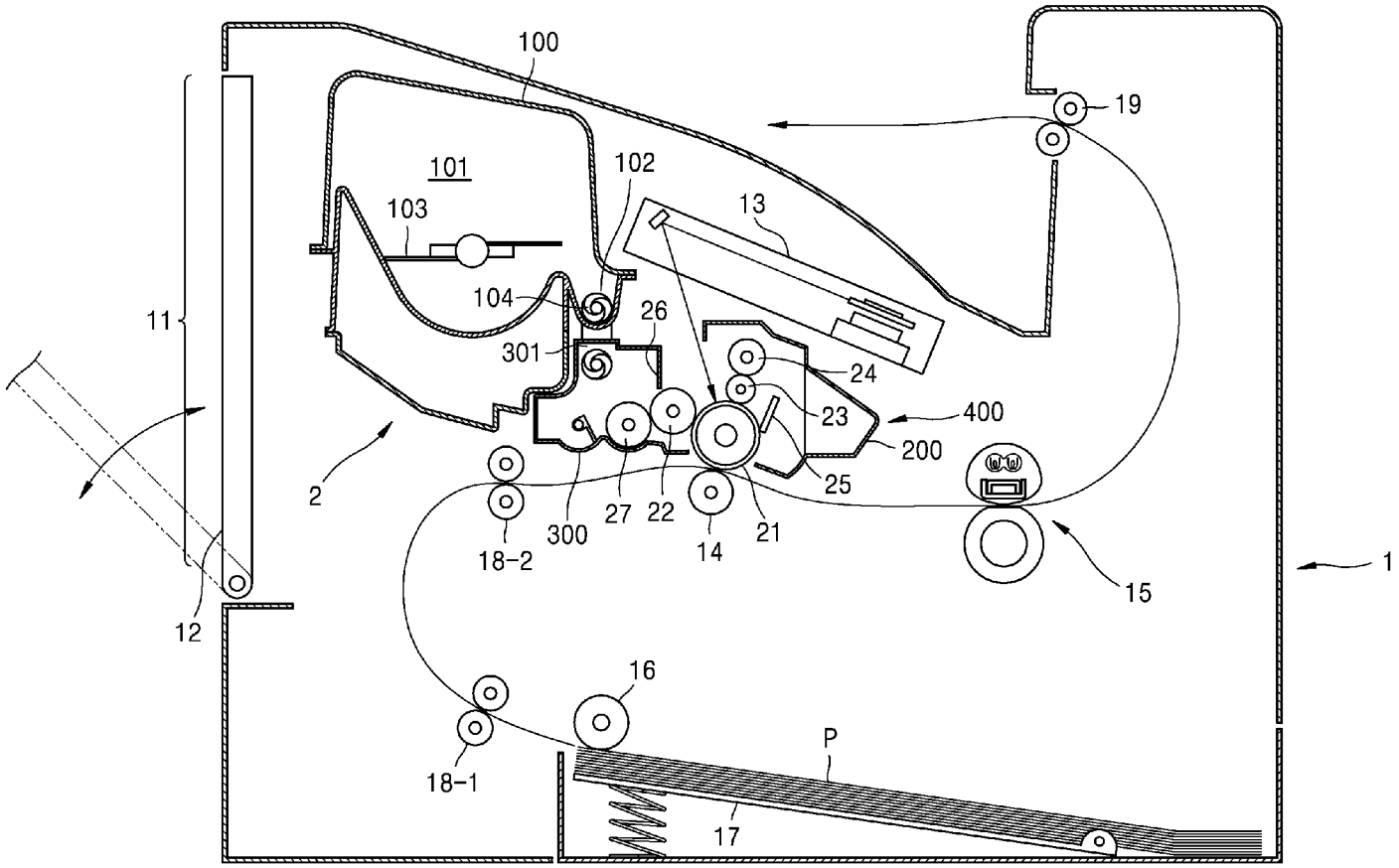
FIG. 1 is a schematic view illustrating an electrophotographic image forming apparatus according to an embodiment.

Reference will now be made in detail to the embodiments, examples of which are illustrated in the accompanying drawings, wherein like reference numerals refer to the like elements throughout. The embodiments are described below to explain the present invention by referring to the figures.

Embodiments will now be described with reference to the accompanying drawings. In the following description and accompanying drawings, elements having substantially the same functions and structures are indicated with the same reference numerals, and repeated descriptions thereof will be omitted.

FIG. 1 is a schematic view illustrating an electrophotographic image forming apparatus according to an embodiment.

Referring to FIG. 1, a main body 1 and a developing device 2 of the image forming apparatus are illustrated. The main body 1 includes an opening 11 forming a path through which the developing device 2 is attached to and detached from the main body 1. A cover 12 is used to open and close the opening 11. An exposing device 13, a transfer roller 14, and a fuser 15 are arranged in the main body 1. A recording medium transfer structure is provided in the main body 1 to receive and transfer a recording medium P.

The developing device 2 may include a toner container 101, a photoconductive drum 21 configured to form an electrostatic latent image thereon, and a developing roller 22 configured to receive toner from the toner container 101 and supplying the toner to the electrostatic latent image so as to develop the electrostatic latent image into a visible toner image.

The developing device 2 may have a first structure divided into an imaging cartridge 400 including the photoconductive drum 21 and the developing roller 22, and a toner cartridge 100 including the toner container 101; a second structure divided into a photoconductor cartridge 200 including the photoconductive drum 21, a developing cartridge 300 including the developing roller 22, and the toner cartridge 100 including the toner container 101; a third structure divided into the photoconductor cartridge 200 and the developing cartridge 300 including the toner container 101; or a fourth structure in which the photoconductor cartridge 200, the developing cartridge 300, and the toner cartridge 100 may be integrally provided.

In a case in which the developing device 2 has the first structure (or the second structure), when the toner cartridge 100 is attached to the main body 1, the toner cartridge 100 may be connected to the imaging cartridge 400 (or the developing cartridge 300). For example, when the toner cartridge 100 is attached to the main body 1, a toner discharge part 102 of the toner cartridge 100 is connected to a toner introduction part 301 of the imaging cartridge 400 (or the developing cartridge 300). According to the structure of the developing device 2, the cartridges 100, 200, 300, and 400 may be individually attached to and detached from the main body 1. For example, in the embodiment, the developing device 2 may have the first structure. Therefore, the imaging cartridge 400 and the toner cartridge 100 may be individually attached to and detached from the main body 1. Hereinafter, the developing cartridge 300 will be referred to as a developing unit 300, and the photoconductor cartridge 200 will be referred to as a photoconductor unit 200.

The toner cartridge 100 may include the toner container 101 and the toner discharge part 102. A first toner supply member 103 may be provided in the toner container 101 to supply toner to the toner discharge part 102. A second toner supply member 104 may be provided in the toner discharge part 102 to supply toner to a toner outlet (not shown) located on an end of the toner discharge part 102. The toner outlet (not shown) faces a toner inlet (not shown) provided on a toner introduction part 301 of the developing unit 300. Thus, toner contained in the toner container 101 may be supplied to the developing unit 300.

The photoconductor unit 200 includes the photoconductive drum 21. The photoconductive drum 21 is an example of a photoconductor configured to form an electrostatic latent image thereon. The photoconductive drum 21 may include a conductive metal pipe and a photoconductive layer formed on a circumferential surface of the conductive metal pipe. A charging roller 23 is an example of a charger configured to charge the photoconductive drum 21 so that the photoconductive drum 21 may have a uniform surface potential. A charging brush or a corona charger may be used instead of the charging roller 23. Reference numeral 24 refers to a cleaning roller configured to remove foreign substances from the surface of the charging roller 23. A cleaning blade 25 is an example of a cleaning device configured to remove toner or foreign substances remaining on the surface of the photoconductive drum 21 after a transfer process (described later). Another cleaning device such as a rotary brush may be used instead of the cleaning blade 25.

The developing unit 300 receives toner from the toner cartridge 100 and supplies the toner to an electrostatic latent image formed on the photoconductive drum 21 so as to develop the electrostatic latent image into a visible toner image.

Examples of developing methods include a mono-component developing method using toner, and a dual-component developing method using toner and a carrier. According to an exemplary embodiment, the developing unit 300 uses the mono-component developing method. The developing roller 22 is used to supply toner to the photoconductive drum 21. A developing bias voltage may be applied to the developing roller 22 so as to supply toner to the photoconductive drum 21. Examples of the mono-component developing method may include a contact developing method in which the developing roller 22 and the photoconductive drum 21 are rotated in contact with each other and a non-contact developing method in which the developing roller 22 and the photoconductive drum 21 are rotated with a gap of several tens to several hundreds of microns therebetween.

A regulating member 26 regulates the amount of toner that will be supplied from the developing roller 22 to a developing region in which the developing roller 22 and the photoconductive drum 21 face each other. The regulating blade 26 may be a doctor blade configured to make elastic contact with the developing roller 22. A supply roller 27 supplies toner contained in the developing device 2 to the developing roller 22. A supply bias voltage may be applied to the supply roller 27.

If the dual-component developing method is used, the developing roller 22 is positioned at a distance of several tens to several hundreds of microns from the photoconductive drum 21. Although not shown in FIG. 1, the developing roller 22 may include a hollow cylindrical sleeve and a magnetic roller placed in the hollow cylindrical sleeve. Toner is attached to the surface of a magnetic carrier. The magnetic carrier is applied to the surface of the developing roller 22 and is transferred to a developing region in which the developing roller 22 and the photoconductive drum 21 face each other. Only the toner may be supplied to the photoconductive drum 21 by a developing bias voltage applied between the developing roller 22 and the photoconductive drum 21, and thus an electrostatic latent image formed on the photoconductive drum 21 is developed into a visible toner image. The developing device 2 may include an agitator (not shown) to mix and agitate toner and a carrier and transfer the mixture of the toner and the carrier to the developing roller 22. The agitator may be an auger.

The exposing device 13 emits light modulated according to image data toward the photoconductive drum 21 so as to form an electrostatic latent image on the photoconductive drum 21. Examples of the exposing device 13 may include a laser scanning unit (LSU) using a laser diode as a light source, and a light emitting diode (LED) exposing device using an LED as a light source.

The transfer roller 14 is an example of a transfer device configured to transfer a toner image from the photoconductive drum 21 to a recording medium P. A transfer bias voltage is applied to the transfer roller 14 so as to transfer a toner image to the recording medium P. A corona transfer device or a pin scorotron type transfer device may be used instead of the transfer roller 14.

The recording medium P is picked up sheet by sheet from a medium tray 17 by a pickup roller 16 and fed by feeding rollers 18-1 and 18-2 into a region in which the photoconductive drum 21 and the transfer roller 14 face each other.

The fuser 15 applies heat and pressure to a toner image transferred to a sheet of the recording medium P so as to fuse the toner image on the sheet of the recording medium P. After passing through the fuser 15, the sheet of the recording medium P is discharged to the outside of the main body 1 by discharge rollers 19.

According to an exemplary embodiment, the exposing device 13 emits light modulated according to image data toward the photoconductive drum 21 so as to form an electrostatic latent image on the photoconductive drum 21. The developing roller 22 supplies toner to the electrostatic latent image so as to form a visible toner image on the photoconductive drum 21. The recording medium P stored on the medium tray 17 is fed into the region in which the photoconductive drum 21 and the transfer roller 14 face each other by the pickup roller 16 and the feeding rollers 18-1 and 18-2, and the toner image is transferred from the photoconductive drum 21 to a sheet of the recording medium P by a transfer bias voltage applied to the transfer roller 14. While the sheet of the recording medium P passes through the fuser 15, the toner image is fused on the sheet of the recording medium P by heat and pressure. After the toner image is fused on the sheet of the recording medium P, the sheet of the recording medium P is discharged by the discharge rollers 19.

When the imaging cartridge 400 is attached to the main body 1, the imaging cartridge 400 receives power from the main body 1. Rotary members of the imaging cartridge 400 such as the developing roller 22, the supply roller 27, the photoconductive drum 21, and the charging roller 23 may be rotated.

Figure 2:
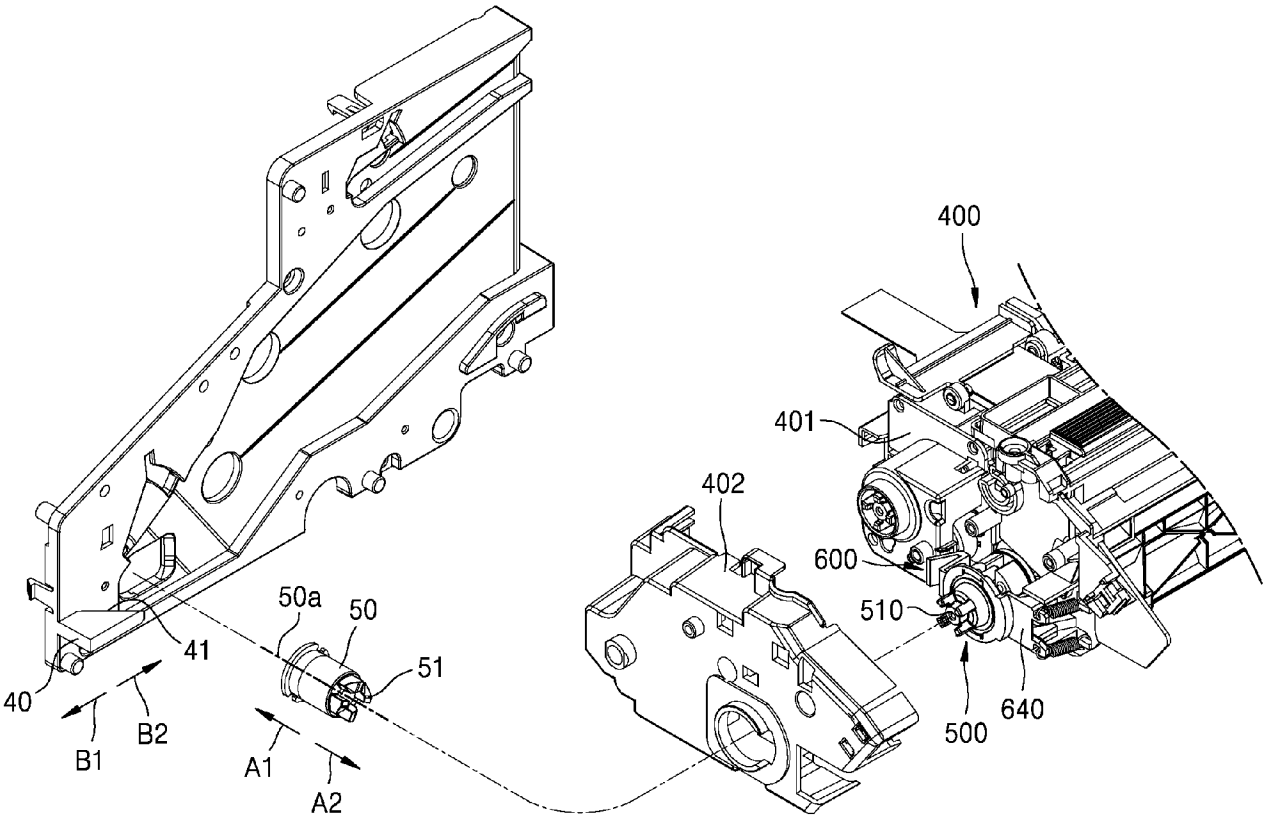
FIG. 2 is a partial perspective view illustrating an imaging cartridge according to an embodiment.
Figure 3:
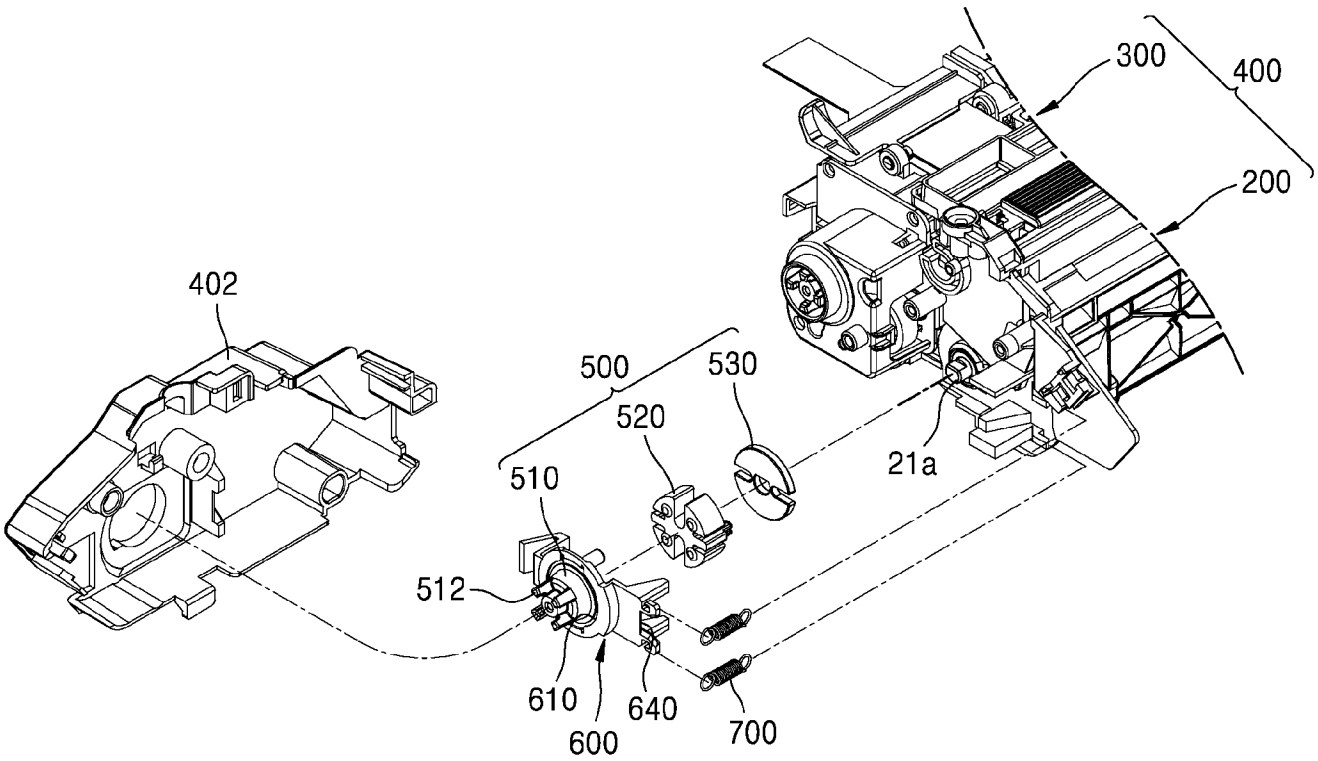
FIG. 3 is a partially exploded perspective view illustrating the imaging cartridge according to an embodiment.
Figure 4:
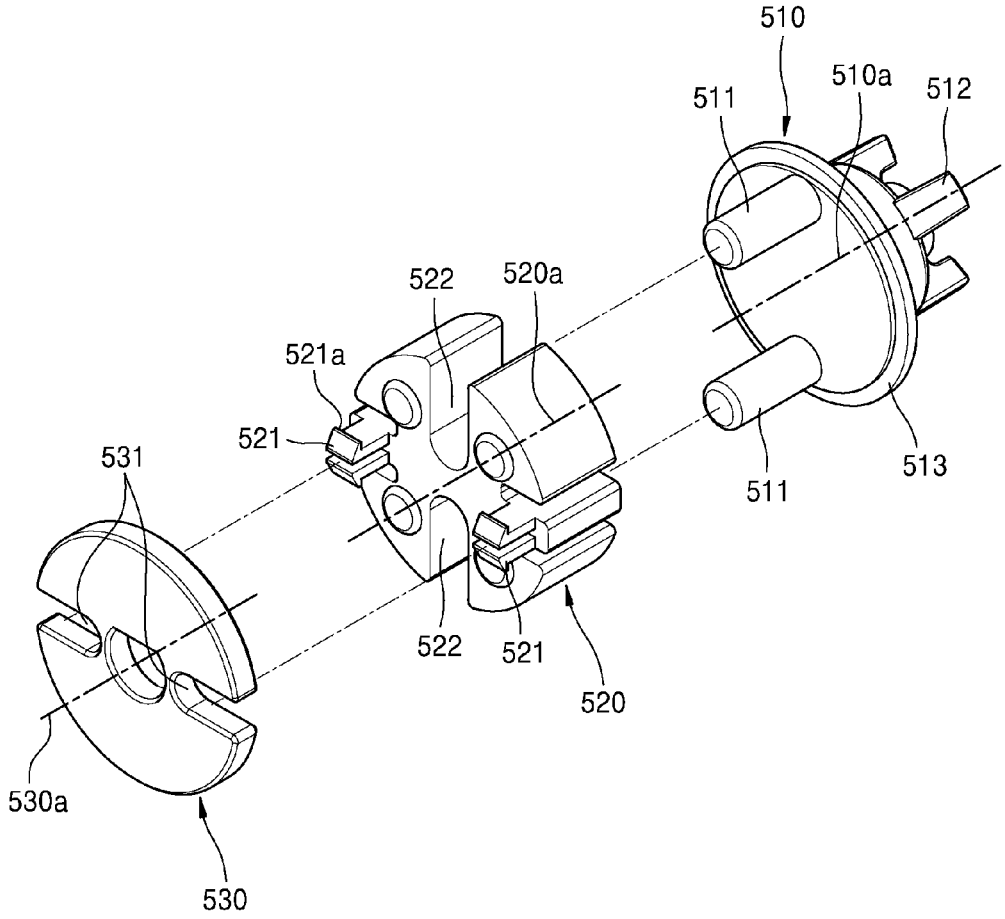
FIG. 4 is an exploded perspective view illustrating a cartridge coupler according to an embodiment.

FIG. 2 is a partial perspective view illustrating the imaging cartridge 400 according to an embodiment. FIG. 3 is another partial perspective view illustrating the imaging cartridge 400 according to an embodiment. FIG. 4 is an exploded perspective view illustrating a cartridge coupler 500 according to an embodiment.

Referring to FIG. 2, the cartridge coupler 500 may be provided on a side of the imaging cartridge 400. When the imaging cartridge 400 is attached to the main body 1, the cartridge coupler 500 is connected to a set coupler 50 of the main body 1 for transmission of power therebetween.

For example, the cartridge coupler 500 may be installed on one of rotary members such as the developing roller 22, the supply roller 27, the photoconductive drum 21, and the charging roller 23. A rotary member (not shown) separate from the developing roller 22, the supply roller 27, the photoconductive drum 21, and the charging roller 23 may be installed on a housing 401 of the imaging cartridge 400, and the cartridge coupler 500 may be provided on the rotary member.

In an embodiment, as illustrated in FIG. 3, the cartridge coupler 500 may be installed on a rotation axis 21*a* of the photoconductive drum 21. The cartridge coupler 500 includes a receiving member 510 connected to the set coupler 50 to receive driving power, a transmission member 530 coupled to the rotation axis 21*a* of the photoconductive drum 21, and a connection member 520 connecting the receiving member 510 and the transmission member 530 to each other. Since the transmission member 530 is fixed on the rotation axis 21*a* of the photoconductive drum 21, a rotation axis 530*a* (refer to FIG. 4) of the transmission member 530 is aligned with the rotation axis 21*a* of the photoconductive drum 21.

The receiving member 510 includes a first coupling part 512 that couples with the set coupler 50 to receive rotation power from the set coupler 50. Referring to FIG. 2, the set coupler 50 includes a second coupling part 51 having a shape complementary to the shape of the first coupling part 512. Thus, when the imaging cartridge 400 is attached to the main body 1, the set coupler 50 may be connected to the receiving member 510, and thus rotation power may be transmitted from the set coupler 50 to the receiving member 510. Rotation power may be transmitted to the photoconductive drum 21 through the connection member 520 and the transmission member 530. Other rotary members may be connected to the photoconductive drum 21 through gear trains (not shown) for transmission of power.

In the embodiment, the cartridge coupler 500 may have an Oldham coupling structure. Referring to FIG. 4, the transmission member 530 includes first grooves 531. The first grooves 531 extend in radial directions of the transmission member 530. The connection member 520 includes first protrusions 521 configured to be inserted into the first grooves 531. The connection member 520 may move in radial directions of the transmission member 530 along the first grooves 531. The connection member 520 includes second grooves 522. The second grooves 522 extend in radial directions of the connection member 520. The second grooves 522 are perpendicular to the first grooves 531. The receiving member 510 includes second protrusions 511 configured to be inserted into the second grooves 522. The receiving member 510 may move in radial directions of the connection member 520 along the second grooves 522. The direction in which the connection member 520 is movable relative to the transmission member 530 is perpendicular to the direction in which the receiving member 510 is movable relative to the connection member 520.

When the imaging cartridge 400 is attached to the main body 1, the rotation axis 21*a* of the photoconductive drum 21 is aligned with a rotation axis 50*a* of the set coupler 50. However, the rotation axis 21*a* of the photoconductive drum 21 may not be aligned with the rotation axis 50*a* of the set coupler 50 because of errors such as assembly errors of the set coupler 50 or positional errors of the imaging cartridge 400 in the main body 1. Since the cartridge coupler 500 has an Oldham coupling structure, although the rotation axis 50*a* of the set coupler 50 is not exactly aligned with the rotation axis 21*a* of the photoconductive drum 21 when the set coupler 50 is connected to the receiving member 510, the connection member 520 moves between the receiving member 510 and the transmission member 530 in a plane perpendicular to axial directions A1 and A2, thereby compensating for axial misalignment. Therefore, rotation power may be stably transmitted from the set coupler 50 to the photoconductive drum 21 through the cartridge coupler 500.

However, the connection member 520 may not be movable relative to the transmission member 530 in the axial directions A1 and A2. In the embodiment, the first protrusions 521 include hooks 521*a* on end portions thereof, and the hooks 521*a* are hooked into the first grooves 531. Thus, the connection member 520 is not separated from the transmission member 530 in the axial directions A1 and A2. In the cartridge coupler 500 of the embodiment, the receiving member 510 may be moved relative to the connection member 520 in the axial directions A1 and A2.

In some embodiments, as illustrated in FIGS. 3 and 4, the imaging cartridge 400 may include a holder 600 movable in the axial directions A1 and A2. The receiving member 510 is rotatably supported on the holder 600. For example, the receiving member 510 includes a disk-shape protrusion 513, and the holder 600 includes a rotation support groove 610 to rotatably support the disk-shape protrusion 513. The holder 600 is supported on the imaging cartridge 400 in such a manner that the holder 600 is movable in the axial directions A1 and A2.

Figure 5:
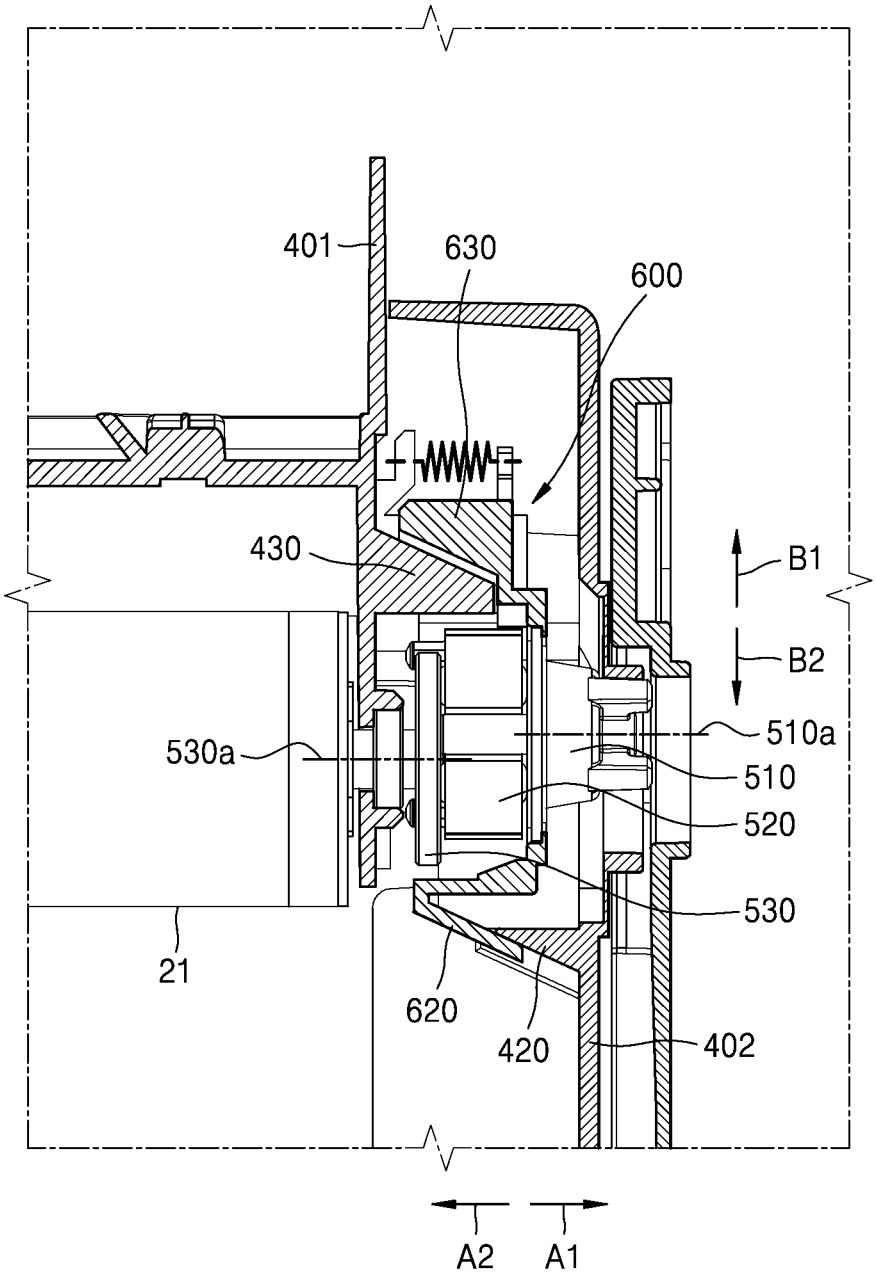
FIGS. 5 and 6 are cross-sectional views schematically illustrating a structure allowing axial movements of a holder according to an embodiment.
Figure 6:
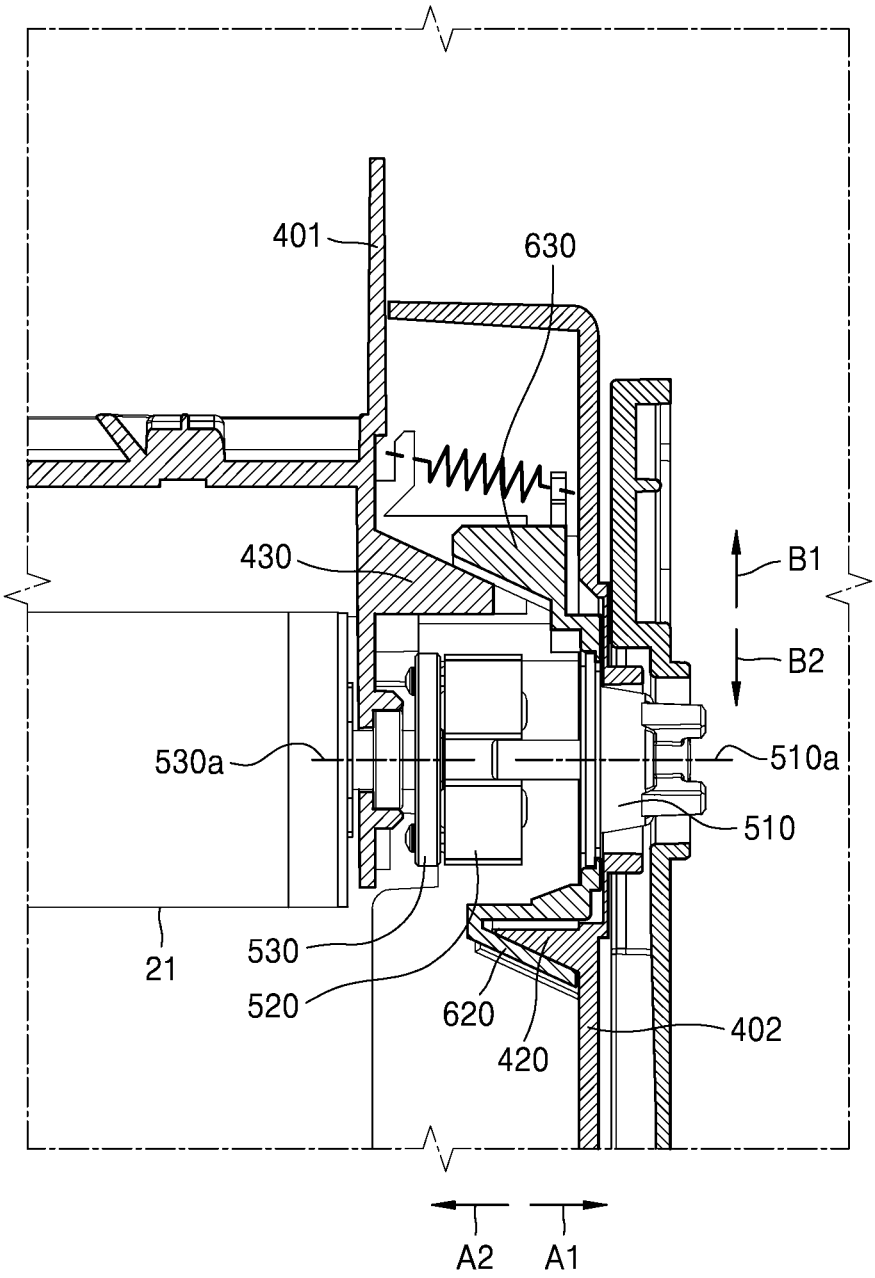

FIGS. 5 and 6 are cross-sectional views schematically illustrating a structure allowing axial movement of the holder 600 according to an embodiment. Referring to FIGS. 3, 5, and 6, the holder 600 includes first guide parts 620 and 630 extending in the axial directions A1 and A2, and the imaging cartridge 400 includes second guide parts 420 and 430 configured to guide the first guide parts 620 and 630. The second guide part 420 corresponding to the first guide part 620 may be provided on a lateral bracket 402 coupled to a lateral wall of the housing 401, and the second guide part 430 corresponding to the first guide part 630 may be provided on the lateral wall of the housing 401.

When the holder 600 is moved in the axial directions A1 and A2, the first guide parts 620 and 630 and the second guide parts 420 and 430 are movable in directions perpendicular to the axial directions A1 and A2, that is, movable in attachment and detachment directions B1 and B2 of the imaging cartridge 400. For example, as illustrated in FIG. 5, the first guide parts 620 and 630 and the second guide parts 420 and 430 have shapes inclined with respect to the axial directions A1 and A2. If a direction in which the receiving member 510 is moved away from the connection member 520 is referred to as a first direction A1, and a direction in which the receiving member 510 is moved close to the connection member 520 is referred to as a second direction A2, the state of the holder 600 may be changed from the state illustrated in FIG. 5 to the state illustrated in FIG. 6 while being moved in the first direction A1 and the detachment direction B2, and may be changed from the state illustrated in FIG. 6 to the state illustrated in FIG. 5 while being moved in the second direction A2 and the attachment direction B1. That is, due to the first guide parts 620 and 630 and the second guide parts 420 and 430, the receiving member 510 may be movable simultaneously in the first direction A1 and the detachment direction B2 and simultaneously in the second direction A2 and the attachment direction B1.

FIG. 5 illustrates a state in which the receiving member 510 is at a first position adjacent to the connection member 520. When the receiving member 510 is placed at the first position, a rotation axis 510*a* of the receiving member 510 is not aligned with the rotation axis 530*a* of the transmission member 530. That is, when the receiving member 510 is placed at the first position, the rotation axis 510*a* of the receiving member 510 is misaligned with the rotation axis 530*a* of the transmission member 530 in the attachment direction B1 of the imaging cartridge 400.

If the holder 600 is pushed in the first direction A1 when the receiving member 510 is placed at the first position, the receiving member 510 is moved in the first direction A1 and the detachment direction B2 as well. Therefore, as illustrated in FIG. 6, while the receiving member 510 is moved away from the connection member 520, the rotation axis 510*a* of the receiving member 510 is moved to a second position adjacent to the rotation axis 530*a* of the transmission member 530.

Thus, the receiving member 510 may be moved to the first position at which the receiving member 510 is adjacent to the connection member 520 and the rotation axis 510*a* of the receiving member 510 is separate from the rotation axis 530*a* of the transmission member 530 in the attachment direction B1, and to the second position at which the receiving member 510 is separate from the connection member 520 and the rotation axis 510*a* of the receiving member 510 is adjacent to the rotation axis 530*a* of the transmission member 530. The lengths of the second protrusions 511 (see, for example, FIG. 4) of the receiving member 510 are determined such that when the receiving member 510 is at the second position, the second protrusions 511 of the receiving member 510 are not separated from the second grooves 522 (refer to FIG. 4).

Referring to FIG. 3, elastic members 700 apply elastic force to move the receiving member 510 in a direction toward the first position. The receiving member 510 is maintained at the first position due to the elastic force of the elastic members 700. In addition, the elastic members 700 apply elastic force to return the receiving member 510 from the second position to the first position. For example, the elastic members 700 may be tension coil springs having ends connected to the holder 600 and the other ends connected to the housing 401.

When the imaging cartridge 400 is attached to the main body 1, the receiving member 510 is moved from the first position to the second position, and when the imaging cartridge 400 is detached from the main body 1, the receiving member 510 is returned from the second position to the first position. When the receiving member 510 is at the second position, the receiving member 510 is connected to the set coupler 50 for transmission of power therebetween. That is, when the receiving member 510 is at the second position, the first coupling part 512 of the receiving member 510 is coupled to the second coupling part 51 of the set coupler 50.

Referring to FIG. 2, a position switch member 40 is provided on the main body 1 to switch the receiving member 510 from the first position to the second position when the imaging cartridge 400 is attached to the main body 1. For example, the position switch member 40 may move the receiving member 510 from the first position to the second position by interfering with an interference part 640 of the holder 600. The position switch member 40 includes a position switch part 41 sloped such that the holder 600 is pushed in the first direction A1 as the holder 600 is moved in the attachment direction B1. Thus, when the imaging cartridge 400 is attached to the main body 1 by pushing the imaging cartridge 400 in the attachment direction B1, the interference part 640 of the holder 600 interferes with the position switch part 41, an thus the holder 600 is moved in the first direction A1, that is, in the opposite direction of the elastic force of the elastic members 700. Thus, the receiving member 510 may be moved to the second position. However, when the imaging cartridge 400 is detached from the main body 1 by pulling the imaging cartridge 400 in the detachment direction B2, the receiving member 510 is returned to the first position by the elastic force of the elastic members 700.

Hereinafter, connection/disconnection of the receiving member 510 to/from the set coupler 50 which is associated with attachment/detachment of the imaging cartridge 400 will be described. FIGS. 7A to 7D are views illustrating connection/disconnection of the receiving member 510 to/from the set coupler 50 which is associated with attachment/detachment of the imaging cartridge 400. In FIGS. 7A to 7D, each element is not illustrated in detail. That is, each element is schematically illustrated.

Figure 7A:
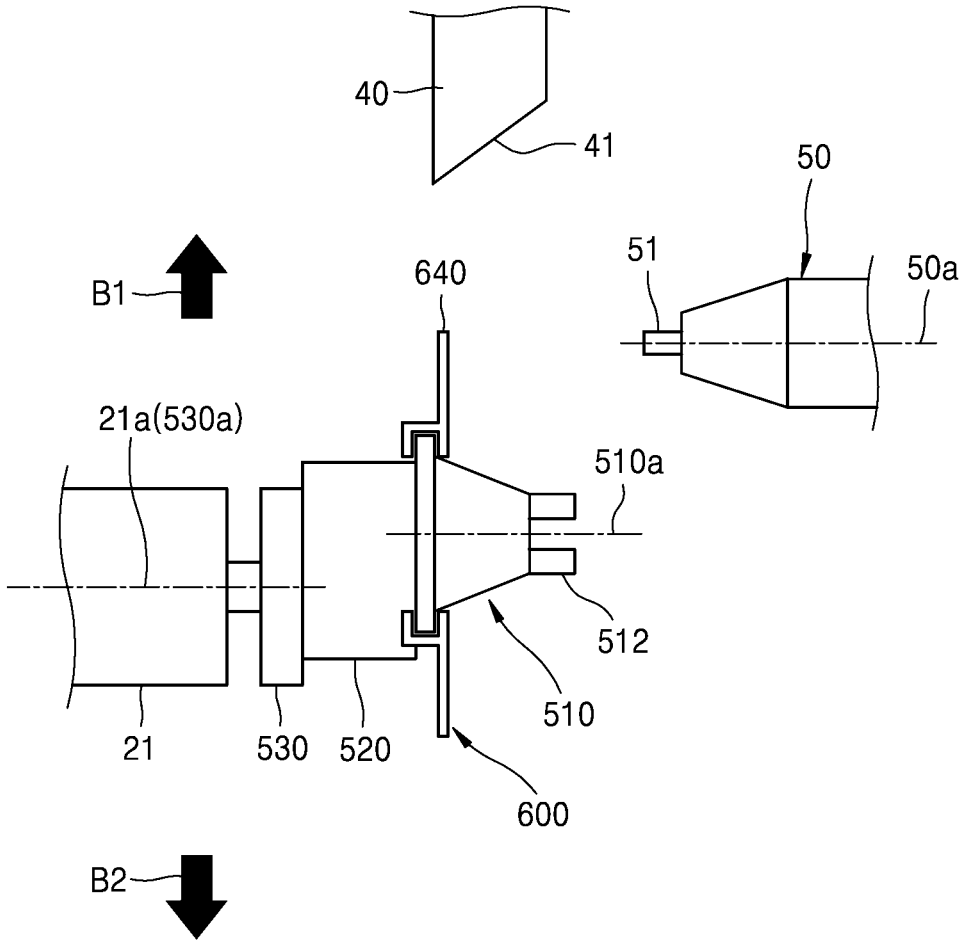
FIGS. 7A to 7D are views illustrating processes of connecting/disconnecting a receiving member and a set coupler to/from each other in association with attachment/detachment of the imaging cartridge.

FIG. 7A illustrates an initial state in which the imaging cartridge 400 starts to be attached to the main body 1. The imaging cartridge 400 is slid on the main body 1 in the attachment direction B1. Due to the elastic force of the elastic members 700, for example, the receiving member 510 may be placed at the first position at which the receiving member 510 is adjacent to the connection member 520 and the rotation axis 510*a* of the receiving member 510 is misaligned with the rotation axis 530*a* of the transmission member 530 in the attachment direction B1. The interference part 640 of the holder 600 is separate from the position switch part 41.

Figure 7B:
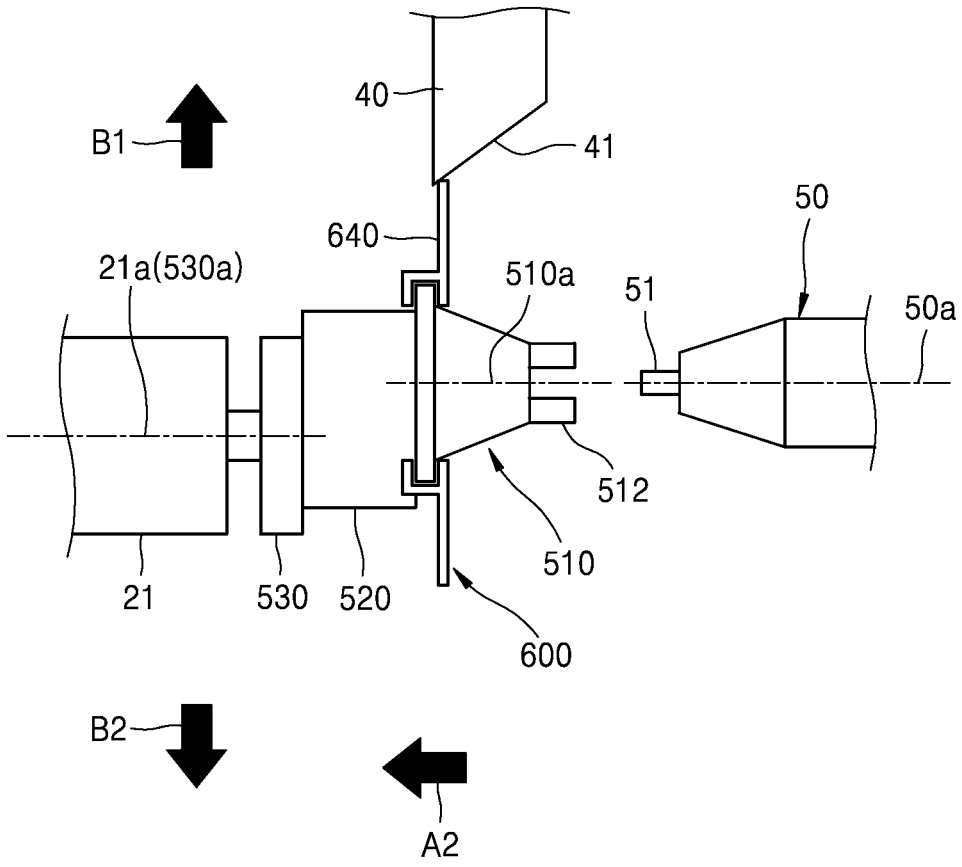

Referring to FIG. 7B, when the rotation axis 510*a* of the receiving member 510 is aligned with the rotation axis 50*a* of the set coupler 50 as the imaging cartridge 400 is inserted into the main body 1, the interference part 640 of the holder 600 is brought into contact with the position switch part 41 of the position switch member 40. The expression "the rotation axis 510*a* of the receiving member 510 is aligned with the rotation axis 50*a* of the set coupler 50" is not limited to a state in which the rotation axis 510*a* of the receiving member 510 is exactly aligned with the rotation axis 50*a* of the set coupler 50 but is also applicable to an almost aligned state and a state in which alignment errors may be compensated for by an Oldham coupler structure.

Figure 7C:
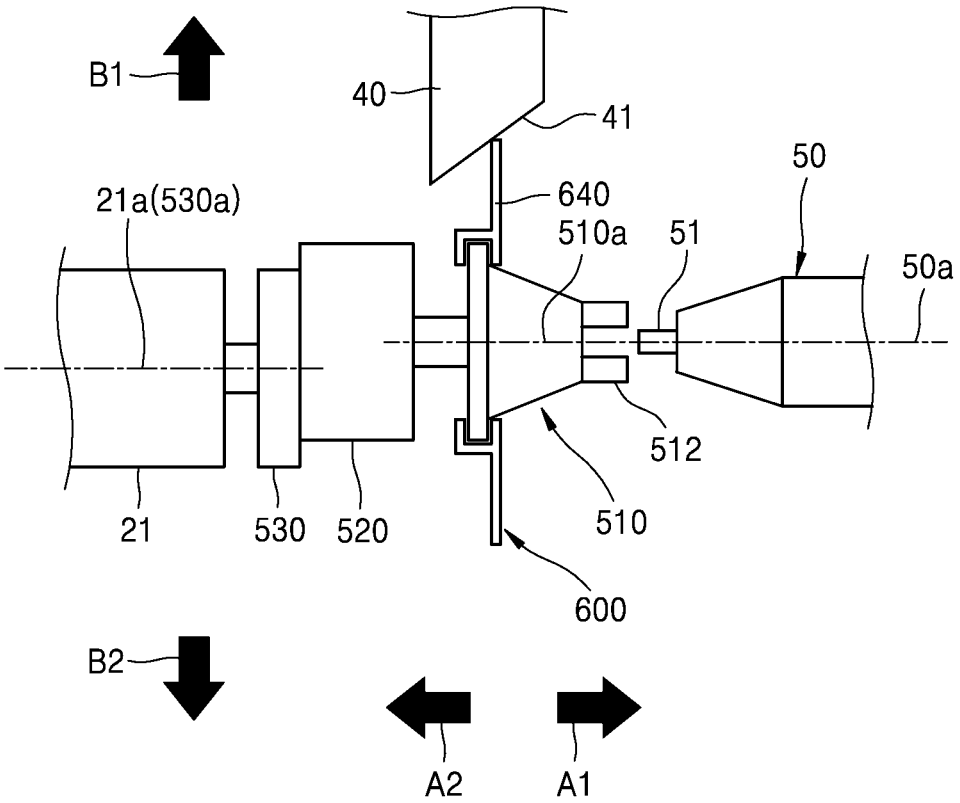

In the state illustrated in FIG. 7B, if the imaging cartridge 400 is further moved in the attachment direction B1, the interference part 640 of the holder 600 interferes with the position switch part 41 of the position switch member 40. As illustrated in FIG. 7C, the holder 600 may be pushed while being guided by the position switch part 41 and the first and second guide parts 620, 630, 420, and 430 in the opposite direction of the elastic force of the elastic members 700, that is, in the first direction A1, and thus the receiving member 510 approaches the set coupler 50. Since the interference part 640 of the holder 600 is in contact with the position switch part 41, the movement of the holder 600 and the receiving member 510 supported by the holder 600 may be restricted in the attachment direction B1. Therefore, the rotation axis 510*a* of the receiving member 510 and the rotation axis 50*a* of the set coupler 50 are maintained in an aligned state. In addition, the connection member 520 and the transmission member 530 are further moved in the attachment direction B1, and thus the rotation axis 530*a* of the transmission member 530 approaches the rotation axis 510*a* of the receiving member 510.

Figure 7D:
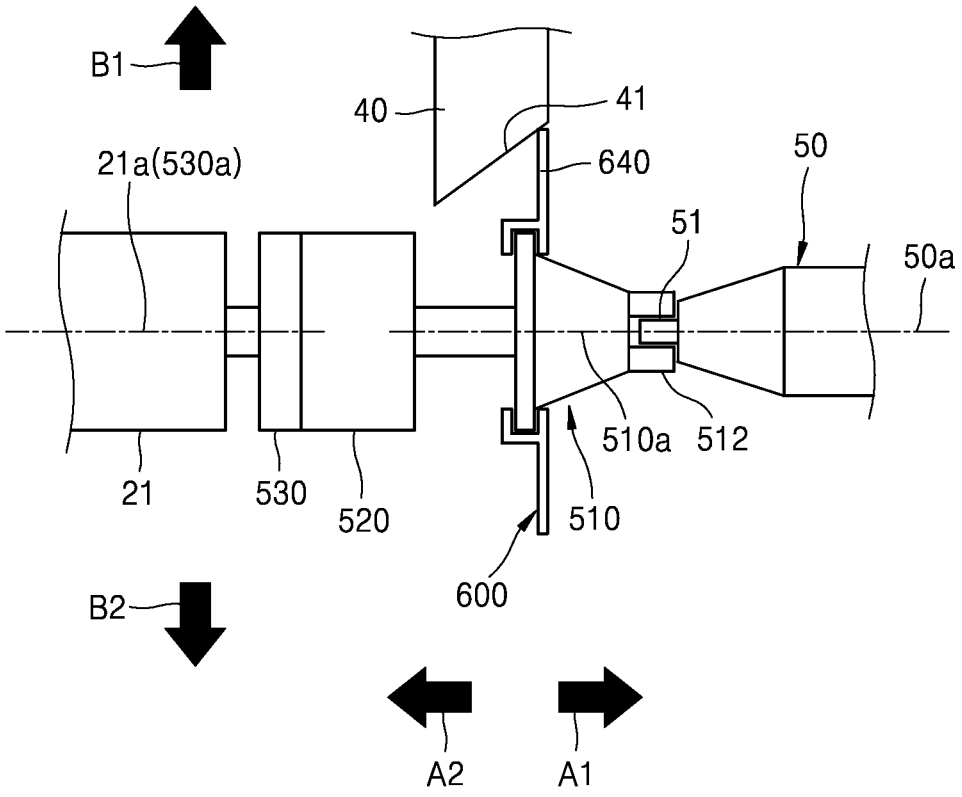

As illustrated in FIG. 7D, when the imaging cartridge 400 is completely attached to the main body 1, the receiving member 510 is at the second position. The first coupling part 512 of the receiving member 510 engages with the second coupling part 51 of the set coupler 50, and thus rotation power may be transmitted from the set coupler 50 to the receiving member 510. In addition, the rotation axis 530*a* of the transmission member 530 is aligned with the rotation axis 510*a* of the receiving member 510. The expression "the rotation axis 530*a* of the transmission member 530 is aligned with the rotation axis 510*a* of the receiving member 510" is not limited to a state in which the rotation axis 530*a* of the transmission member 530 is exactly aligned with the rotation axis 510*a* of the receiving member 510 but is also applicable to an almost aligned state and a state in which alignment errors may be compensated for by an Oldham coupler structure.

Detachment of the imaging cartridge 400 from the main body 1 is described while sequentially referring to FIGS. 7D, 7C, 7B, and 7A.

In the state illustrated in FIG. 7D, the receiving member 510 is at the second position. If the imaging cartridge 400 is pulled in the detachment direction B2, the holder 600 is moved in the second direction A2 by the elastic force of the elastic members 700 in a state in which the interference part 640 is in contact with the position switch part 41 as illustrated in FIG. 7C. The first coupling part 512 of the receiving member 510 starts to depart from the second coupling part 51 of the set coupler 50. Since the movement of the holder 600 in the attachment direction B1 is restricted by the interference part 640 and the position switch part 41, the rotation axis 510*a* of the receiving member 510 and the rotation axis 50*a* of the set coupler 50 are maintained in an aligned state. Instead, since the transmission member 530 and the connection member 520 are moved in the detachment direction B2, the rotation axis 510*a* of the receiving member 510 is separated from and misaligned with the rotation axis 530*a* of the transmission member 530 in the attachment direction B1.

As illustrated in FIG. 7B, until the interference part 640 stops to interfere with the position switch part 41, the alignment between the rotation axis 510*a* of the receiving member 510 and the rotation axis 50*a* of the set coupler 50 is maintained, and the first and second coupling parts 512 and 51 are separated from each other. The receiving member 510 is returned to the first position by the elastic force of the elastic members 700.

If the imaging cartridge 400 is further pulled in the detachment direction B2, the interference between the interference part 640 and the position switch part 41 stops, and as illustrated in FIG. 7A, the receiving member 510 is moved together with the transmission member 530 and the connection member 520 in the detachment direction B2, resulting in misalignment between the rotation axis 510*a* of the receiving member 510 and the rotation axis 50*a* of the set coupler 50. In this state, if the imaging cartridge 400 is further pulled in the detachment direction B2, the imaging cartridge 400 may be detached from the main body 1.

The set coupler 50 and the cartridge coupler 500 may be connected to each other or disconnected from each other in an interactional relationship with attachment/detachment of the imaging cartridge 400. In addition, while the set coupler 50 is connected to or disconnected from the receiving member 510 of the cartridge coupler 500, the set coupler 50 and the receiving member 510 are maintained in an aligned state, and thus connection/disconnection processes may be smoothly performed for stable transmission of power. In addition, the generation of abnormal sounds or noises may be reduced during such connection/disconnection processes. Furthermore, during such connection/disconnection processes, the receiving member 510 and/or the set coupler 50 may be prevented from being damaged by collision.

According to an exemplary embodiment, the position switch member 40 switches the receiving member 510 from the first position to the second position while making contact with the holder 600. However, according to other embodiments, the receiving member 510 may be switched from the first position to the second position by magnetic force.

Figure 8:
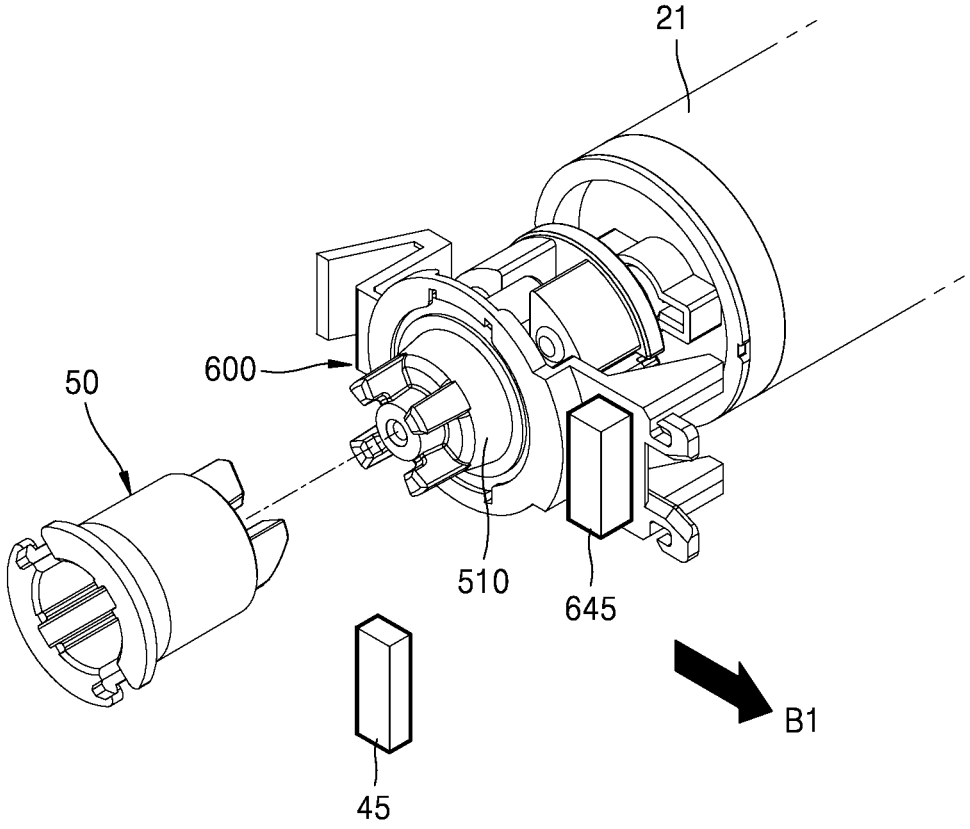
FIG. 8 is a perspective view illustrating a structure for switching the receiving member from a first position to a second position by magnetic force according to an embodiment.

FIG. 8 is a perspective view illustrating a structure for switching the receiving member 510 from the first position to the second position by magnetic force according to an embodiment. Referring to FIG. 8, instead of the position switch member 40 and the interference part 640, a first magnetic member 645 is provided on the holder 600, and a second magnetic member 45 is provided on the main body 1. The first magnetic member 645 is placed on a side in the attachment direction of the imaging cartridge 400 based on the receiving member 510. The second magnetic member 45 is placed on a side located in the attachment direction B1 of the imaging cartridge 400 based on the set coupler 50. Since the first and second magnetic members 645 and 45 magnetically attract each other, the holder 600 is forced to move in the first direction A1. In this manner, the receiving member 510 may be switched from the first position to the second position by magnetic attraction. One of the first magnetic member 645 and the second magnetic member 45 may be a magnet, and the other of the first magnetic member 645 and the second magnetic member 45 may include a material sticking to a magnet. Alternatively, both the first and second magnetic members 645 and 45 may be magnets.

Connection/disconnection of the receiving member 510 to/from the set coupler 50 which is associated with attachment/detachment of the imaging cartridge 400 are described. FIGS. 9A to 9D are views illustrating connection/disconnection of the receiving member 510 to/from the set coupler 50 which is associated with attachment/detachment of the imaging cartridge 400. In FIGS. 9A to 9D, each element is not illustrated in detail. That is, each element is schematically illustrated.

Figure 9A:
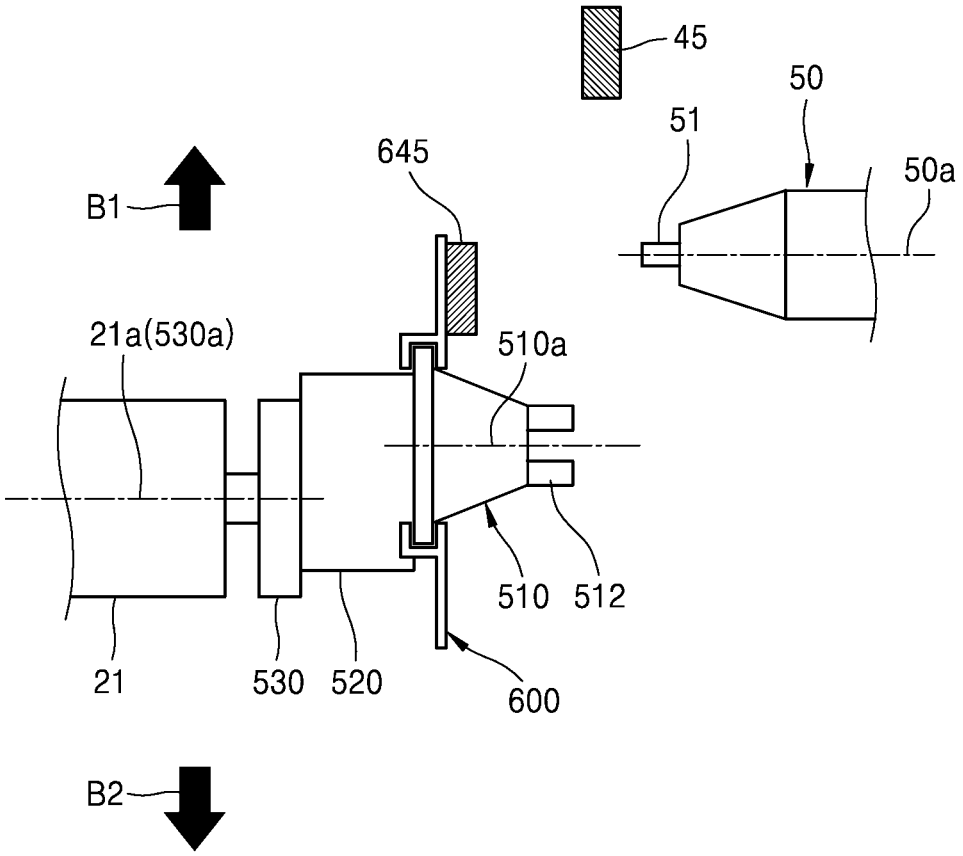
FIGS. 9A to 9D are views illustrating processes of connecting/disconnecting the receiving member and the set coupler to/from each other in association with attachment/detachment of the imaging cartridge.

FIG. 9A illustrates an initial state in which the imaging cartridge 400 starts to be attached to the main body 1. The imaging cartridge 400 is slid on the main body 1 in the attachment direction B1. Due to the elastic force of the elastic members 700, for example, the receiving member 510 may be placed at the first position at which the receiving member 510 is adjacent to the connection member 520 and the rotation axis 510*a* of the receiving member 510 is misaligned with the rotation axis 530*a* of the transmission member 530 in the attachment direction B1. The first magnetic member 645 is separate from the second magnetic member 45.

Figure 9B:
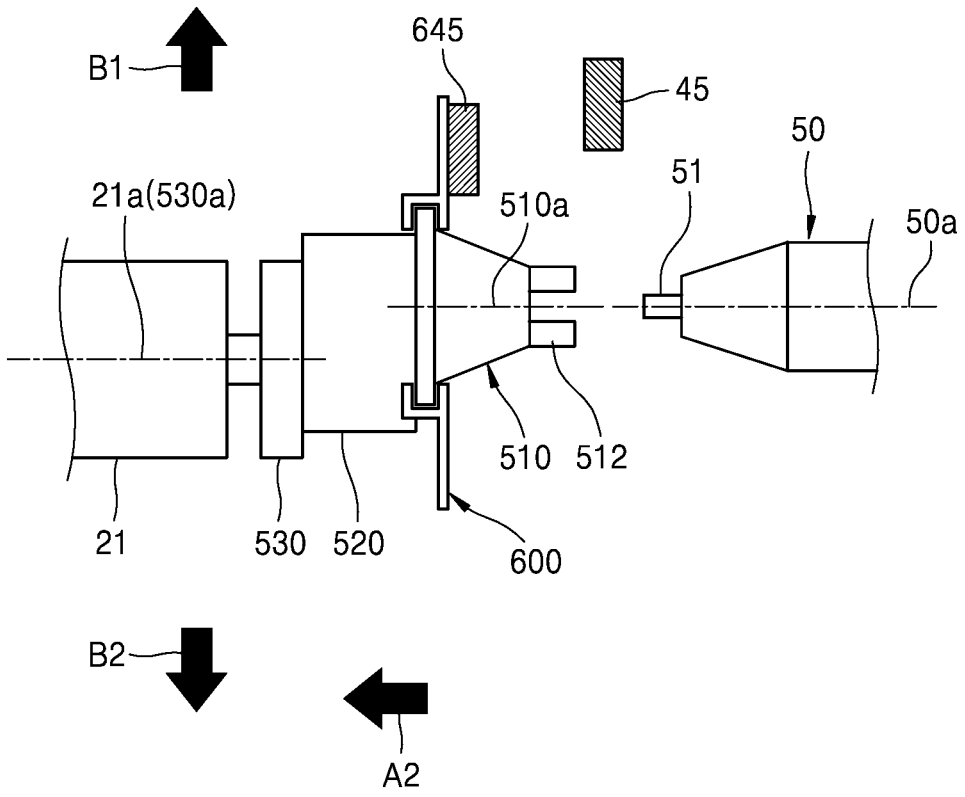

Referring to FIG. 9B, when the rotation axis 510*a* of the receiving member 510 is aligned with the rotation axis 50*a* of the set coupler 50 as the imaging cartridge 400 is inserted into the main body 1, the first magnetic member 645 and the second magnetic member 45 approach each other, and thus magnetic attractive force acts between the first magnetic member 645 and the second magnetic member 45. The expression "the rotation axis 510*a* of the receiving member 510 is aligned with the rotation axis 50*a* of the set coupler 50" is not limited to a state in which the rotation axis 510*a* of the receiving member 510 is exactly aligned with the rotation axis 50*a* of the set coupler 50 but is also applicable to an almost aligned state and a state in which alignment errors may be compensated for by an Oldham coupler structure.

Figure 9C:
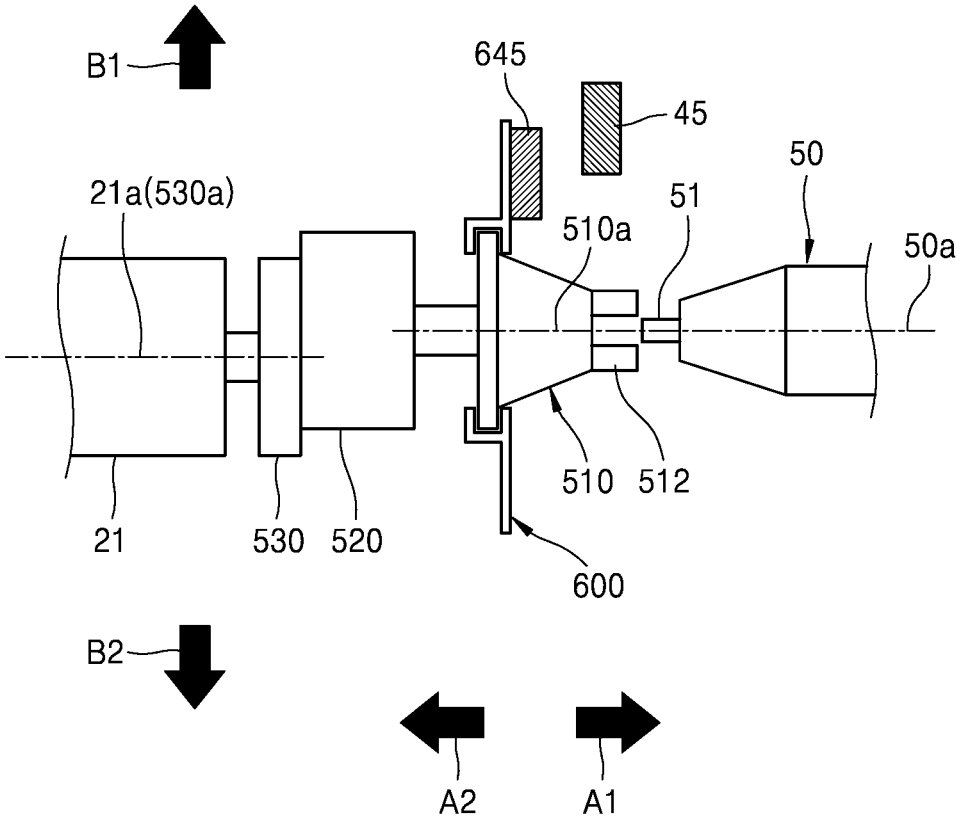

In the state illustrated in FIG. 9B, if the imaging cartridge 400 is further moved in the attachment direction B1, the magnetic attractive force between the first and second magnetic members 645 and 45 exceeds the elastic force of the elastic members 700. As illustrated in FIG. 9C, the holder 600 is moved by the magnetic attractive force in the opposite direction of the elastic force of the elastic members 700, that is, in the first direction A1, while being guided by the first and second guide parts 620, 630, 420, and 430. The receiving member 510 approaches the set coupler 50. At the same time, the movement of the holder 600 and the receiving member 510 supported by the holder 600 is restricted in the attachment direction B1 by the first and second guide parts 620, 630, 420, and 430, and thus the rotation axis 510*a* of the receiving member 510 and the rotation axis 50*a* of the set coupler 50 are maintained in an aligned state. In addition, the connection member 520 and the transmission member 530 are further moved in the attachment direction B1, and thus the rotation axis 530*a* of the transmission member 530 approaches the rotation axis 510*a* of the receiving member 510.

Figure 9D:
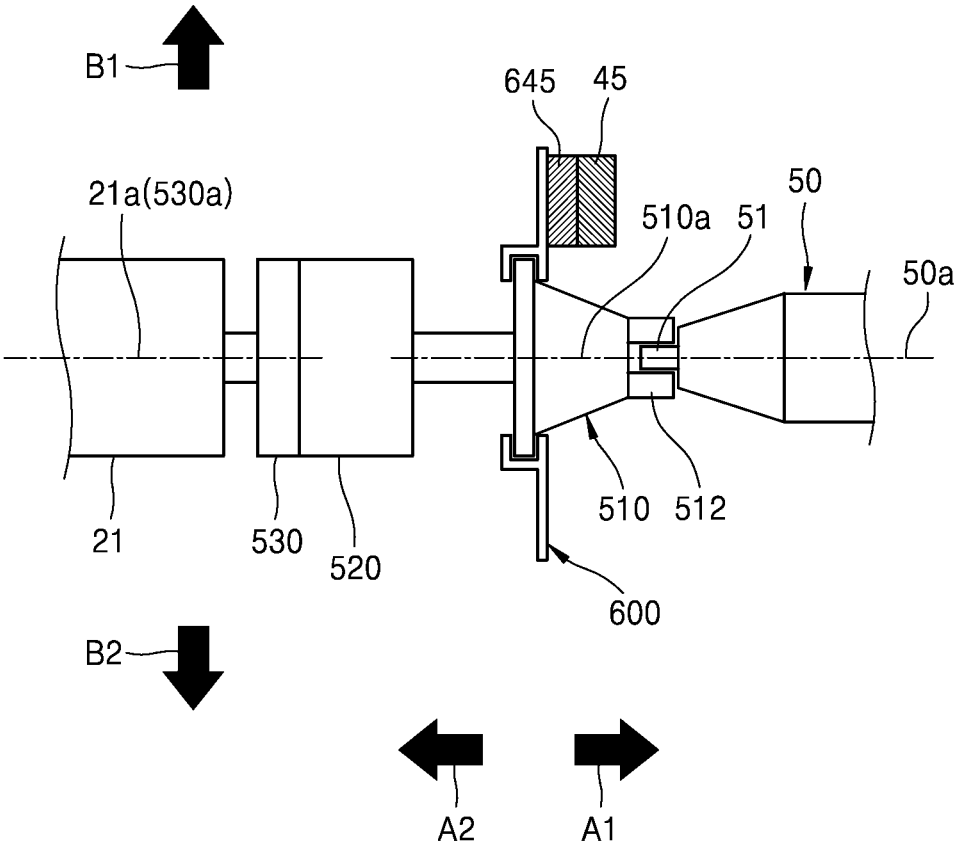

As illustrated in FIG. 9D, when the imaging cartridge 400 is completely attached to the main body 1, the first and second magnetic members 645 and 45 face each other at positions closest to each other, and the receiving member 510 is placed at the second position. The first coupling part 512 of the receiving member 510 engages with the second coupling part 51 of the set coupler 50, and thus rotation power may be transmitted from the set coupler 50 to the receiving member 510. In addition, the rotation axis 530*a* of the transmission member 530 is aligned with the rotation axis 510*a* of the receiving member 510. The expression "the rotation axis 530*a* of the transmission member 530 is aligned with the rotation axis 510*a* of the receiving member 510" is not limited to a state in which the rotation axis 530*a* of the transmission member 530 is exactly aligned with the rotation axis 510*a* of the receiving member 510 but is also applicable to an almost aligned state and a state in which alignment errors may be compensated for by an Oldham coupler structure.

The imaging cartridge 400 may be detached from the main body 1 in the reverse order of attachment.

In the state illustrated in FIG. 9D, the receiving member 510 is placed at the second position. If the imaging cartridge 400 is pulled in the detachment direction B2, the first and second magnetic members 645 and 45 start to be misaligned with each other in the detachment direction B2. The connection between the receiving member 510 and the set coupler 50 is maintained, and the transmission member 530 and the connection member 520 are moved in the detachment direction B2. Thus, as illustrated in FIG. 9C, the rotation axis 510*a* of the receiving member 510 is separated from the rotation axis 530*a* of the transmission member 530 and is thus misaligned with the rotation axis 530*a* of the transmission member 530 in the attachment direction B1.

In the state illustrated in FIG. 9B, the magnetic attractive force between the first and second magnetic members 645 and 45 becomes weaker than the elastic force of the elastic members 700, and the first and second magnetic members 645 and 45 are moved away from each other. The holder 600 is moved in the second direction A2 by the elastic force of the elastic members 700. The receiving member 510 is separated from the set coupler 50. The holder 600 is guided by the first and second guide parts 620, 630, 420, and 430, and the receiving member 510 is returned to the first position as illustrated in FIG. 9A. In this state, if the imaging cartridge 400 is further pulled in the detachment direction B2, the imaging cartridge 400 may be detached from the main body 1.

In the above-described embodiments, the receiving member 510 is movable in axial directions, that is, in the first and second directions A1 and A2. However, the receiving member 510 may be movable in directions perpendicular to the first and second directions A1 and A2, for example, in the attachment and detachment directions B1 and B2, and the set coupler 50 may be moved in axial directions according to attachment/detachment of the imaging cartridge 400.

Figure 10:
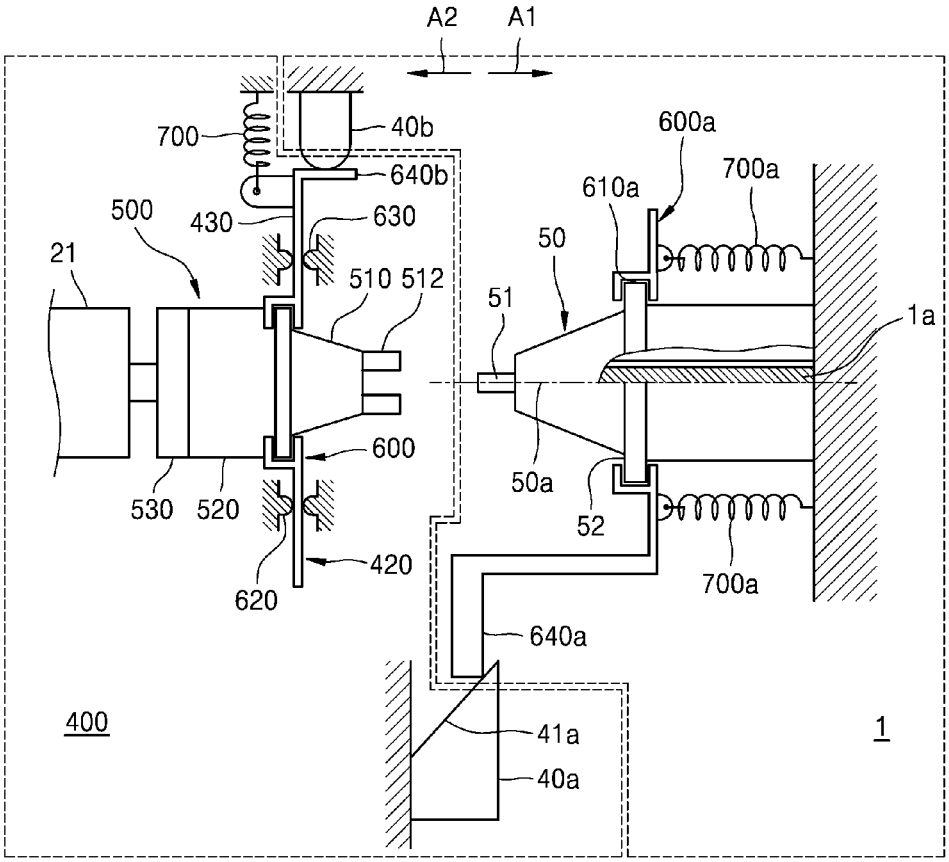
FIG. 10 is a partial cross-sectional view illustrating a cartridge coupler and a set coupler according to another embodiment.

FIG. 10 is a partial cross-sectional view illustrating a cartridge coupler 500 and a set coupler 50 according to another embodiment. Referring to FIG. 10, a receiving member 510 is supported by an imaging cartridge 400 and movable in attachment and detachment directions B1 and B2. For example, a holder 600 includes first guide parts 420 and 430 extending in the attachment and detachment directions B1 and B2, and the imaging cartridge 400 includes second guide parts 620 and 630 to guide the first guide parts 420 and 430. A first elastic member 700 applies elastic force to place the receiving member 510 at the first position at which a rotation axis 510*a* of the receiving member 510 is misaligned with a rotation axis 530*a* of a transmission member 530 in the attachment direction B1. For example, the first elastic member 700 may be a tension coil spring having an end connected to the holder 600 and the other end supported by a housing 401 of the imaging cartridge 400.

The set coupler 50 is movable along a rotation axis 1*a* provided in a main body 1, that is, in first and second directions A1 and A2. The set coupler 50 may include a disk-shaped protrusion 52, and a set holder 600*a* may include a support groove 610*a* to receive the disk-shaped protrusion 52 while allowing rotation of the disk-shaped protrusion 52. Second elastic members 700*a* exert elastic force to the set coupler 50 in a direction away from the receiving member 510, that is, in the first direction A1. Due to the elastic force of the second elastic members 700*a*, for example, the set coupler 50 may be maintained at a disconnection position separate from the receiving member 510. For example, the second elastic members 700*a* may be tension coil springs having ends connected to the set holder 600*a* and the other ends connected to the main body 1.

The set holder 600*a* includes a first interference part 640*a*. The imaging cartridge 400 includes a first position switch member 40*a*, and when the imaging cartridge 400 is attached to the main body 1, the first position switch member 40*a* moves the set coupler 50 from the disconnection position to a connection position to connect the set coupler 50 to the receiving member 510. For example, since the first position switch member 40*a* interferes with the first interference part 640*a* of the set holder 600*a*, the set coupler 50 may be moved to the connection position. The first position switch member 40*a* includes a position switch part 41*a* sloped such that the set holder 600*a* is pushed in the second direction A2 as the first position switch member 40*a* is moved in the attachment direction B1. Thus, when the imaging cartridge 400 is attached to the main body 1 by pushing the imaging cartridge 400 in the attachment direction B1, the first interference part 640*a* of the set holder 600*a* interferes with the position switch part 41*a*, and thus the set holder 600*a* is moved in the second direction A2, that is, moved in the opposite direction of the elastic force of the second elastic members 700*a*. In this manner, the set coupler 50 may be moved to the connection position. However, when the imaging cartridge 400 is detached from the main body 1 by pulling the imaging cartridge 400 in the detachment direction B2, the set coupler 50 is returned to the disconnection position by the elastic force of the second elastic members 700*a*.

The holder 600 includes a second interference part 640*b*. The main body 1 includes a second position switch member 40*b* configured to move the receiving member 510 from the first position to a second position when the imaging cartridge 400 is attached to the main body 1. For example, the second position switch member 40*b* may move the receiving member 510 to the second position by interfering with the second interference part 640*b* of the holder 600.

Hereinafter, connection/disconnection of the receiving member 510 to/from the set coupler 50 which is associated with attachment/detachment of the imaging cartridge 400 will be described. FIGS. 11A to 11D are views illustrating connection/disconnection of the receiving member 510 to/from the set coupler 50 which is associated with attachment/detachment of the imaging cartridge 400. In FIGS. 11A to 11D, each element is not illustrated in detail. That is, each element is schematically illustrated.

Figure 11A:
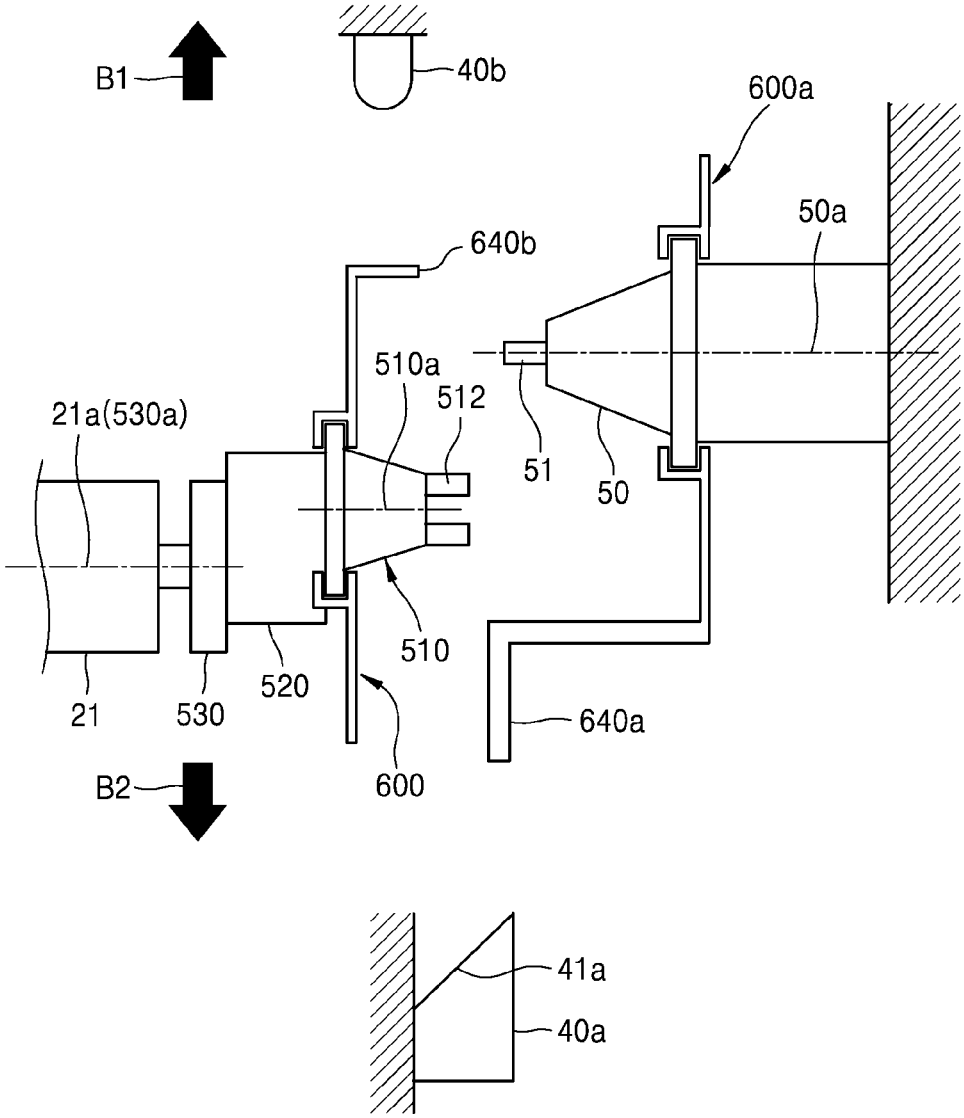
FIGS. 11A to 11D are views illustrating processes of connecting/disconnecting a receiving member and the set coupler to/from each other in association with attachment/detachment of an imaging cartridge.

FIG. 11A illustrates an initial state in which the imaging cartridge 400 starts to be attached to the main body 1. The imaging cartridge 400 is slid on the main body 1 in the attachment direction B1. Due to the elastic force of the first elastic member 700, for example, the receiving member 510 may be placed at the first position at which the rotation axis 510*a* of the receiving member 510 is misaligned with the rotation axis 530*a* of the transmission member 530 in the attachment direction B1. The second interference part 640*b* of the holder 600 is separate from the second position switch member 40*b* of the main body 1.

Figure 11B:
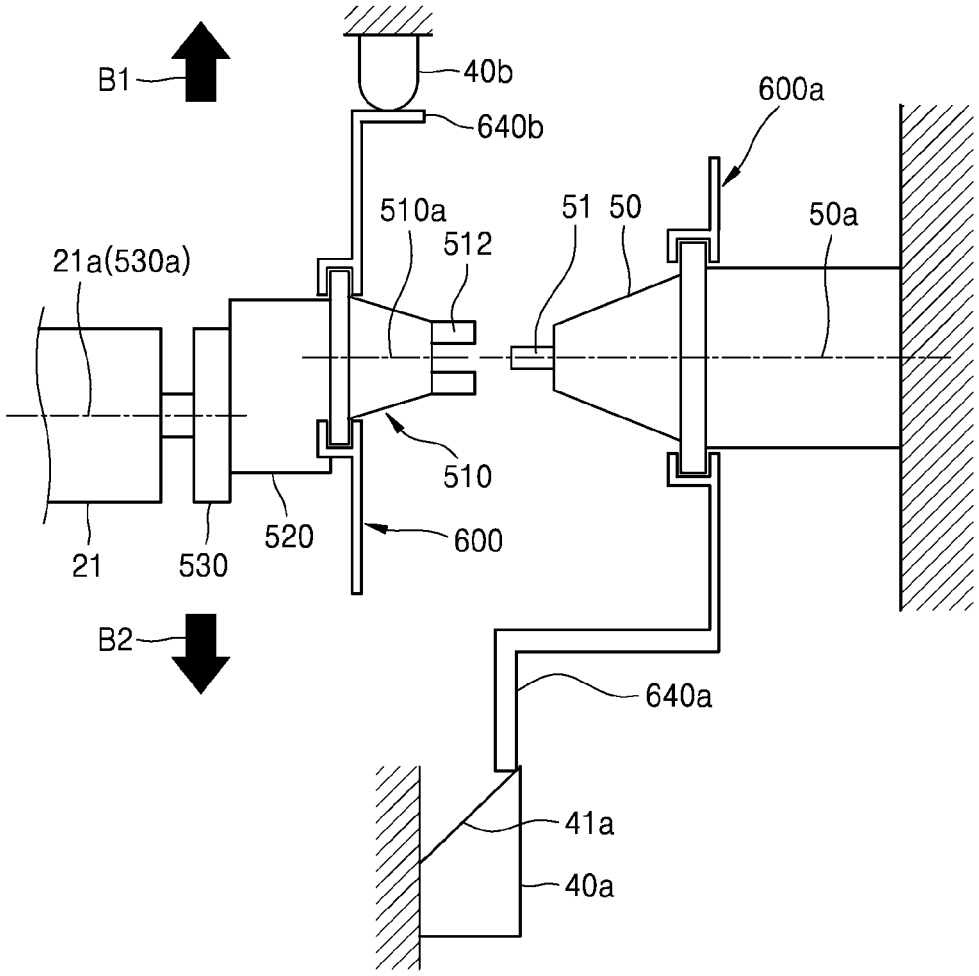

Referring to FIG. 11B, when the rotation axis 510*a* of the receiving member 510 is aligned with a rotation axis 50*a* of the set coupler 50 as the imaging cartridge 400 is inserted into the main body 1, the second interference part 640*b* of the holder 600 is brought into contact with the second position switch member 40*b*. In addition, the first position switch member 40*a* of the imaging cartridge 400 is brought into contact with the first interference part 640*a* of the set holder 600*a*. The expression "the rotation axis 510*a* of the receiving member 510 is aligned with the rotation axis 50*a* of the set coupler 50" is not limited to a state in which the rotation axis 510*a* of the receiving member 510 is exactly aligned with the rotation axis 50*a* of the set coupler 50 but is also applicable to an almost aligned state and a state in which alignment errors may be compensated for by an Oldham coupler structure.

Figure 11C:
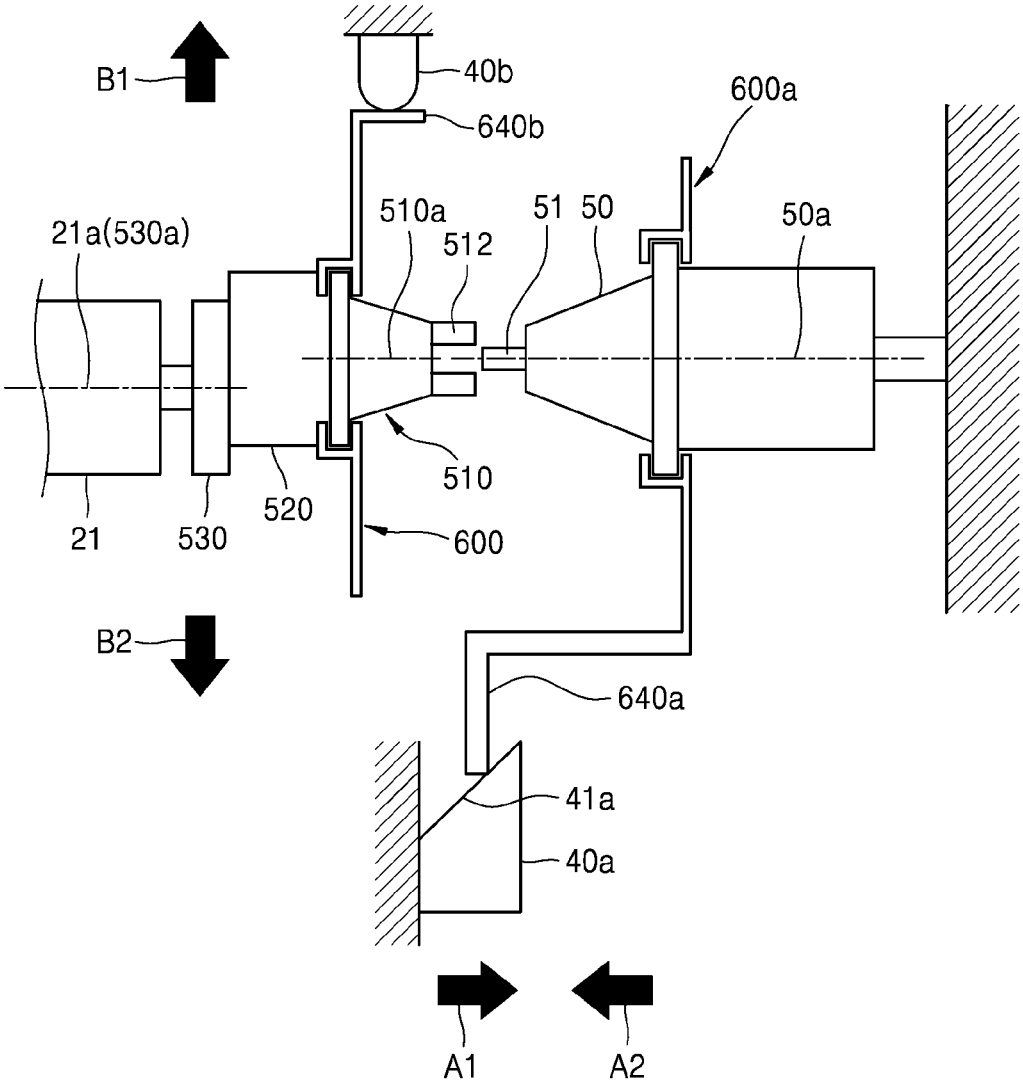

In the state illustrated in FIG. 11B, if the imaging cartridge 400 is further moved in the attachment direction B1, the first interference part 640*a* of the set holder 600*a* interferes with the position switch part 41*a* of the first position switch member 40*a*. As illustrated in FIG. 11C, the set holder 600*a* and the set coupler 50 supported by the set holder 600*a* are pushed in the opposite direction of the elastic force of the second elastic members 700*a*, that is, pushed in the second direction A2, and thus the set coupler 50 approaches the receiving member 510. At this time, since the second interference part 640*b* of the holder 600 is in contact with the second position switch member 40*b* of the main body 1, the movement of the holder 600 and the receiving member 510 supported by the holder 600 is restricted in the attachment direction B1. Therefore, the rotation axis 510*a* of the receiving member 510 and the rotation axis 50*a* of the set coupler 50 are maintained in an aligned state. In addition, a connection member 520 and the transmission member 530 are further moved in the attachment direction B1, and thus the rotation axis 530*a* of the transmission member 530 approaches the rotation axis 510*a* of the receiving member 510.

Figure 11D:
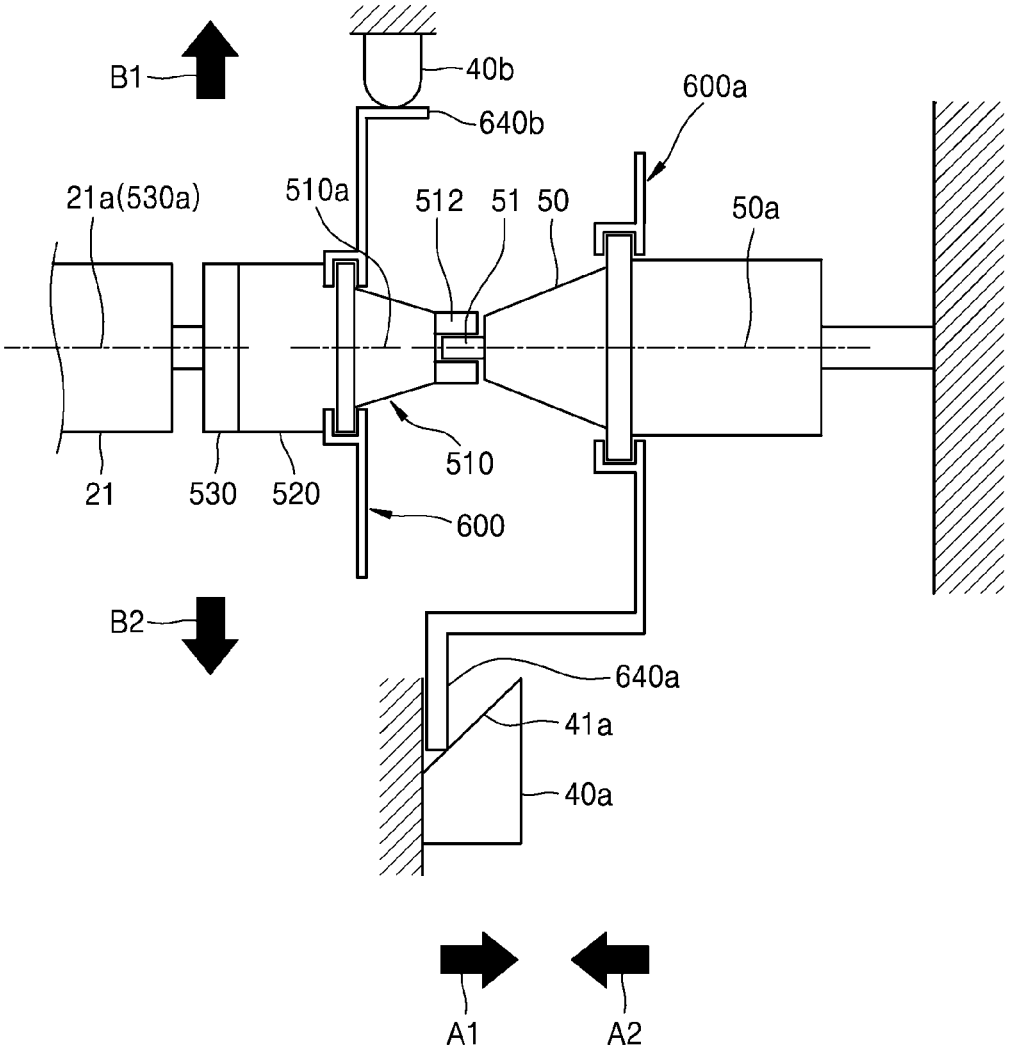

As illustrated in FIG. 11D, when the imaging cartridge 400 is completely attached to the main body 1, the receiving member 510 is placed at the second position. The set coupler 50 is placed in the connection position. A first coupling part 512 of the receiving member 510 engages with a second coupling part 51 of the set coupler 50, and thus rotation power may be transmitted from the set coupler 50 to the receiving member 510. In addition, the rotation axis 530*a* of the transmission member 530 is aligned with the rotation axis 510*a* of the receiving member 510. The expression "the rotation axis 530*a* of the transmission member 530 is aligned with the rotation axis 510*a* of the receiving member 510" is not limited to a state in which the rotation axis 530*a* of the transmission member 530 is exactly aligned with the rotation axis 510*a* of the receiving member 510 but is also applicable to an almost aligned state and an state in which alignment errors may be compensated for by an Oldham coupler structure.

Detachment of the imaging cartridge 400 from the main body 1 will now be described while sequentially referring to FIGS. 11D, 11C, 11B, and 11A.

In the state illustrated in FIG. 11D, the receiving member 510 is placed at the second position. If the imaging cartridge 400 is pulled in the detachment direction B2, the set coupler 50 is moved in the first direction A1 by the elastic force of the second elastic members 700*a* in a state in which the first interference part 640*a* is in contact with the first position switch part 41*a* as illustrated in FIG. 11C. Then, the first coupling part 512 of the receiving member 510 starts to depart from the second coupling part 51 of the set coupler 50. Since the movement of the holder 600 in the detachment direction B2 is restricted by the elastic force of the first elastic member 700 and the contact between the second interference part 640*b* and the second position switch member 40*b*, the rotation axis 510*a* of the receiving member 510 and the rotation axis 50*a* of the set coupler 50 are maintained in an aligned state. Instead, since the transmission member 530 and the connection member 520 are moved in the detachment direction B2, the rotation axis 510*a* of the receiving member 510 is separated from and misaligned with the rotation axis 530*a* of the transmission member 530 in the attachment direction B1.

As illustrated in FIG. 11B, until the first interference part 640*a* stops to interfere with the first position switch part 41*a*, the alignment between the rotation axis 510*a* of the receiving member 510 and the rotation axis 50*a* of the set coupler 50 is maintained, and the first and second coupling parts 512 and 51 are separated from each other. Due to the elastic force of the second elastic members 700*a*, for example, the set coupler 50 may be returned to the disconnection position.

If the imaging cartridge 400 is further pulled in the detachment direction B2, the second interference part 640*b* is separated from the second position switch member 40*b*, and as illustrated in FIG. 11A, the rotation axis 510*a* of the receiving member 510 is maintained at a position not aligned with the rotation axis 50*a* of the set coupler 50 by the elastic force of the first elastic member 700. In this state, if the imaging cartridge 400 is further pulled in the detachment direction B2, the imaging cartridge 400 may be detached from the main body 1.

Figure 12:
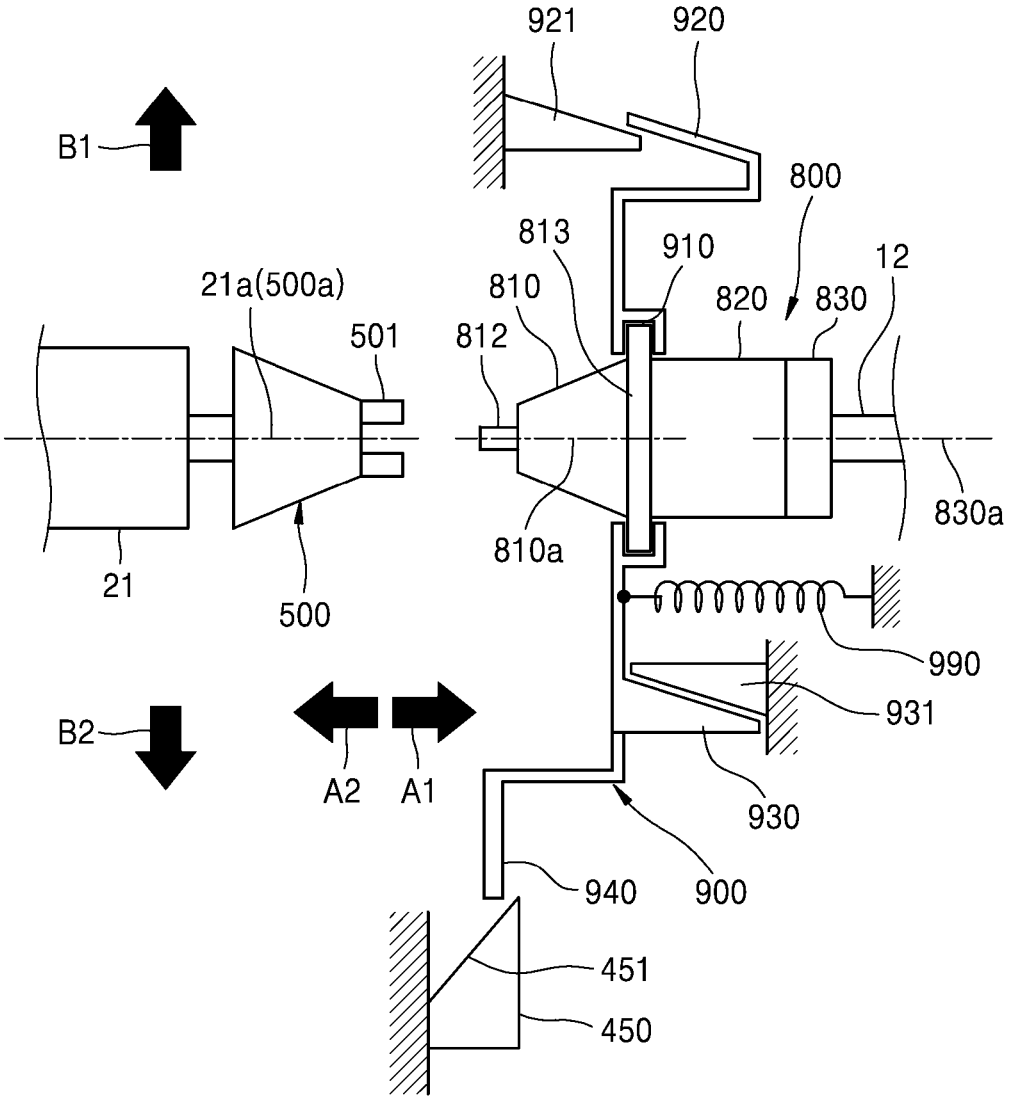
FIG. 12 is a schematic view illustrating a power connection structure between a cartridge and a main body according to another embodiment.

FIG. 12 is a schematic view illustrating a power connection structure between a cartridge and a main body 1 according to another embodiment. In the power connection structure of the embodiment, an Oldham coupler structure is used as a set coupler. Referring to FIG. 12, a cartridge coupler 500 is provided on a side of an imaging cartridge 400. When the imaging cartridge 400 is attached to the main body 1, a set coupler 800 of the main body 1 is connected to the cartridge coupler 500 for transmission of power therebetween. In an embodiment, the cartridge coupler 500 may be installed on a rotation axis 21*a* of a photoconductive drum 21.

The set coupler 800 includes a driving member 810 connected to the cartridge coupler 500 to transmit driving power, a transmission member 830 configured to be rotated by driving power of a motor (not shown) provided in the main body 1, and a connection member 820 connecting the driving member 810 and the transmission member 830 to each other.

The cartridge coupler 500 includes a first coupling part 501 to receive rotation power from the driving member 810. The driving member 810 includes a second coupling part 812 having a shape complementary to the shape of the first coupling part 501. Thus, when the imaging cartridge 400 is attached to the main body 1, the cartridge coupler 500 may be connected to the driving member 810, and thus rotation power may be transmitted from the driving member 810 to the photoconductive drum 21 through the cartridge coupler 500. The charging roller 23 may be connected to the photoconductive drum 21 through a gear train (not shown) for transmission of power therebetween.

In the embodiment, the set coupler 800 has an Oldham coupling structure. The transmission member 830 has the same structure as the transmission member 530 illustrated in FIG. 4. The connection member 820 has the same structure as the connection member 520 illustrated in FIG. 4. The driving member 810 has the same structure as the receiving member 510 illustrated in FIG. 4. The driving member 810 is movable relative to the connection member 820 in axial directions A1 and A2. In an embodiment, the driving member 810 may be supported by a holder 900.

The holder 900 has the same structure as the holder 600 illustrated in FIG. 5. The driving member 810 includes a disk-shape protrusion 813, and the holder 900 includes a rotation support groove 910 to support the disk-shape protrusion 813 while allowing rotation of the disk-shaped protrusion 813. The holder 900 is supported on the main body 1 in such a manner that the holder 900 is movable in axial directions A1 and A2. First guide parts 920 and 930 are guided by second guide parts 921 and 931 provided in the main body 1. When the holder 900 is moved in the axial directions A1 and A2, the first guide parts 920 and 930 and the second guide parts 921 and 931 are movable in directions perpendicular to the axial directions A1 and A2, that is, movable in attachment and detachment directions B1 and B2 of the imaging cartridge 400. The first guide parts 920 and 930 and the second guide parts 921 and 931 have the same structures as the first guide parts 620 and 630 and the second guide parts 420 and 430 illustrated in FIG. 5.

The driving member 810 may be moved to a first position at which the driving member 810 is adjacent to the connection member 820 and a rotation axis 810*a* of the driving member 810 is misaligned with a rotation axis 830*a* of the transmission member 830 in the detachment direction B2, and to a second position at which the driving member 810 is separate from the connection member 820 and the rotation axis 810*a* of the driving member 810 is adjacent to the rotation axis 830*a* of the transmission member 830. An elastic member 990 applies elastic force to place the driving member 810 at the first position. Due to the elastic force of the elastic member 990, the driving member 810 may be returned to the first position from the second position. For example, the elastic member 990 may be a tension coil spring having an end connected to the holder 900 and the other end connected to the main body 1.

When the imaging cartridge 400 is attached to the main body 1, the driving member 810 is moved from the first position to the second position, and when the imaging cartridge 400 is detached from the main body 1, the driving member 810 is returned from the second position to the first position. When the driving member 810 is at the second position, the driving member 810 is connected to the cartridge coupler 500 for transmission of power therebetween.

The imaging cartridge 400 includes a position switch member 450, and when the imaging cartridge 400 is attached to the main body 1, the position switch member 450 moves the driving member 810 from the first position to the second position. For example, the position switch member 450 may move the driving member 810 from the first position to the second position by interfering with an interference part 940 of the holder 900. The position switch member 450 has the same structure as the position switch member 40 illustrated in FIG. 2. The position switch member 450 includes a position switch part 451 sloped in such a manner that when the imaging cartridge 400 is moved in the attachment direction B1, the position switch part 451 pushes the holder 900 in a second direction A2. Thus, when the imaging cartridge 400 is attached to the main body 1 by pushing the imaging cartridge 400 in the attachment direction B1, the interference part 940 of the holder 900 interferes with the position switch part 451, an thus the holder 900 is moved in the second direction A2, that is, in the opposite direction of the elastic force of the elastic member 990. Thus, the driving member 810 may be moved to the second position. However, when the imaging cartridge 400 is detached from the main body 1 by pulling the imaging cartridge 400 in the detachment direction B2, the driving member 810 is returned to the first position by the elastic force of the elastic member 990.

Hereinafter, connection/disconnection of the driving member 810 to/from the cartridge coupler 500 which is associated with attachment/detachment of the imaging cartridge 400 will be described. FIGS. 13A to 13D are views illustrating connection/disconnection of the driving member 810 to/from the cartridge coupler 500 which is associated with attachment/detachment of the imaging cartridge 400. In FIGS. 13A to 13D, each element is not illustrated in detail. That is, each element is schematically illustrated.

Figure 13A:
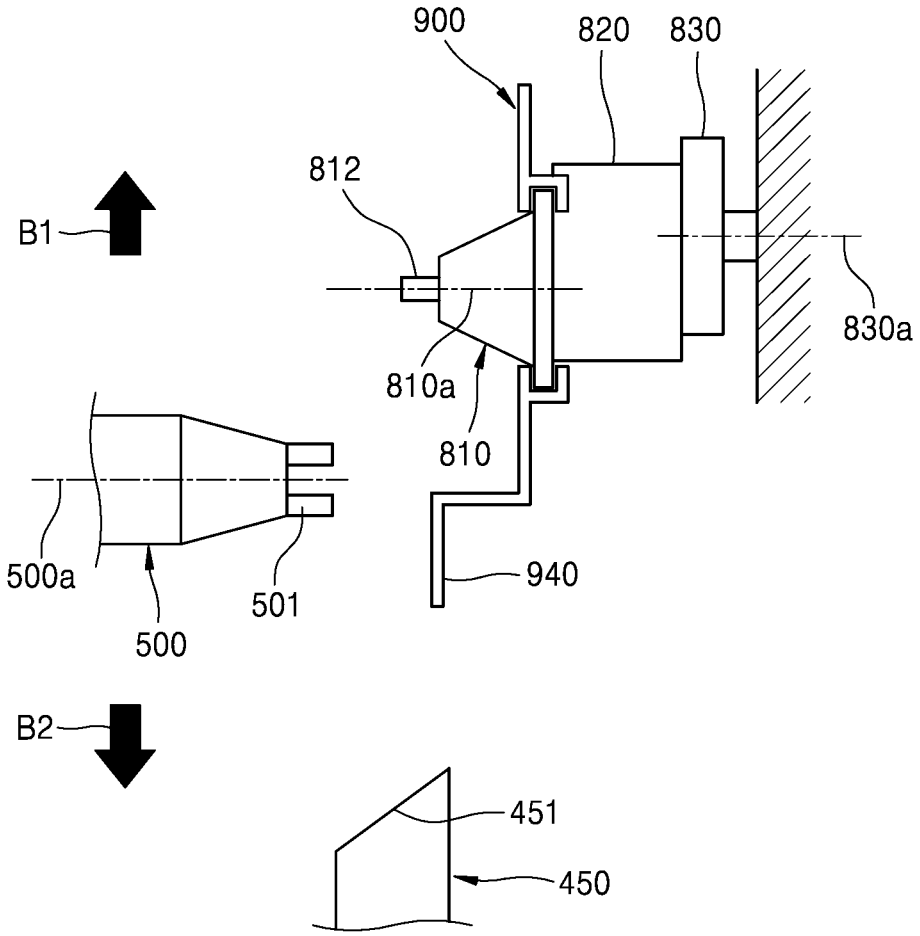
FIGS. 13A to 13D are views illustrating processes of connecting/disconnecting a driving member and a cartridge coupler to/from each other in association with attachment/detachment of the imaging cartridge.

FIG. 13A illustrates an initial state in which the imaging cartridge 400 starts to be attached to the main body 1. The imaging cartridge 400 is slid on the main body 1 in the attachment direction B1. Due to the elastic force of the elastic member 990, the driving member 810 may be placed at the first position at which the driving member 810 is adjacent to the connection member 820 and the rotation axis 810*a* of the driving member 810 is misaligned with the rotation axis 830*a* of the transmission member 830 in the detachment direction B2. The interference part 940 of the holder 900 may be separate from the position switch part 451.

Figure 13B:
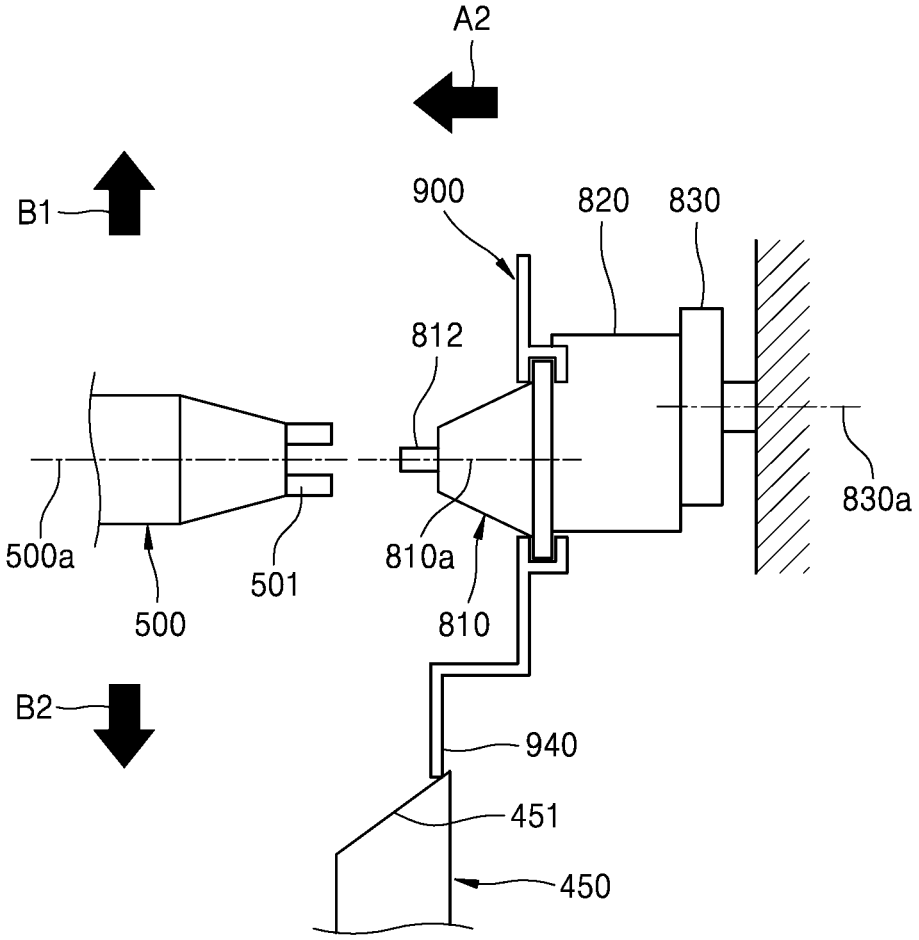

Referring to FIG. 13B, when a rotation axis 500*a* of the cartridge coupler 500 is aligned with the rotation axis 810*a* of the driving member 810 as the imaging cartridge 400 is inserted into the main body 1, the interference part 940 of the holder 900 is brought into contact with the position switch part 451 of the position switch member 450. The expression "the rotation axis 500*a* of the cartridge coupler 500 is aligned with the rotation axis 810*a* of the driving member 810" is not limited to a state in which the rotation axis 500*a* of the cartridge coupler 500 is exactly aligned with the rotation axis 810*a* of the driving member 810 but is also applicable to an almost aligned state and a state in which alignment errors may be compensated for by an Oldham coupler structure.

Figure 13C:
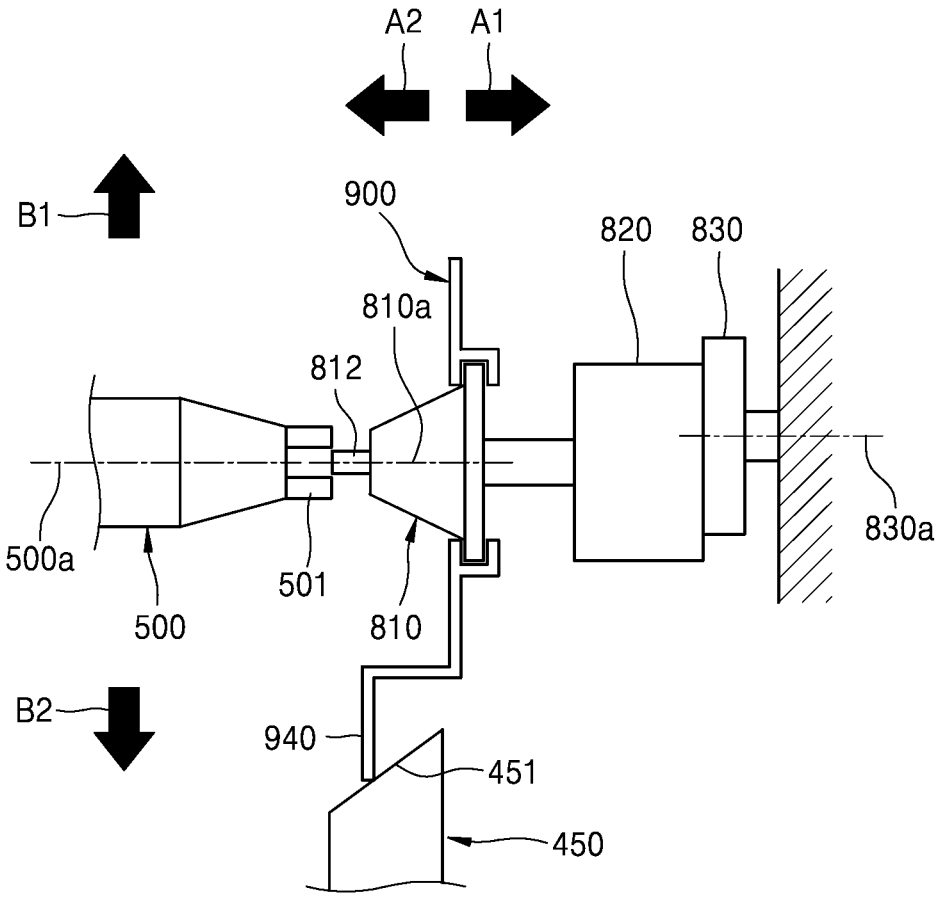

In the state illustrated in FIG. 13B, if the imaging cartridge 400 is further moved in the attachment direction B1, the interference part 940 of the holder 900 interferes with the position switch part 451. As illustrated in FIG. 13C, the holder 900 may be pushed while being guided by the position switch part 451 and the first and second guide parts 920, 930, 921, and 931 in the opposite direction of the elastic force of the elastic member 990, that is, in the second direction A2, and thus the driving member 810 approaches the cartridge coupler 500. At this time, the rotation axis 500*a* of the cartridge coupler 500 and the rotation axis 810*a* of the driving member 810 are maintained in an aligned state because the movement of the holder 900 and the driving member 810 supported by the holder 900 is restricted by the first and second guide parts 920, 930, 921, and 931, and the rotation axis 810*a* of the driving member 810 approaches the rotation axis 830*a* of the transmission member 830.

Figure 13D:
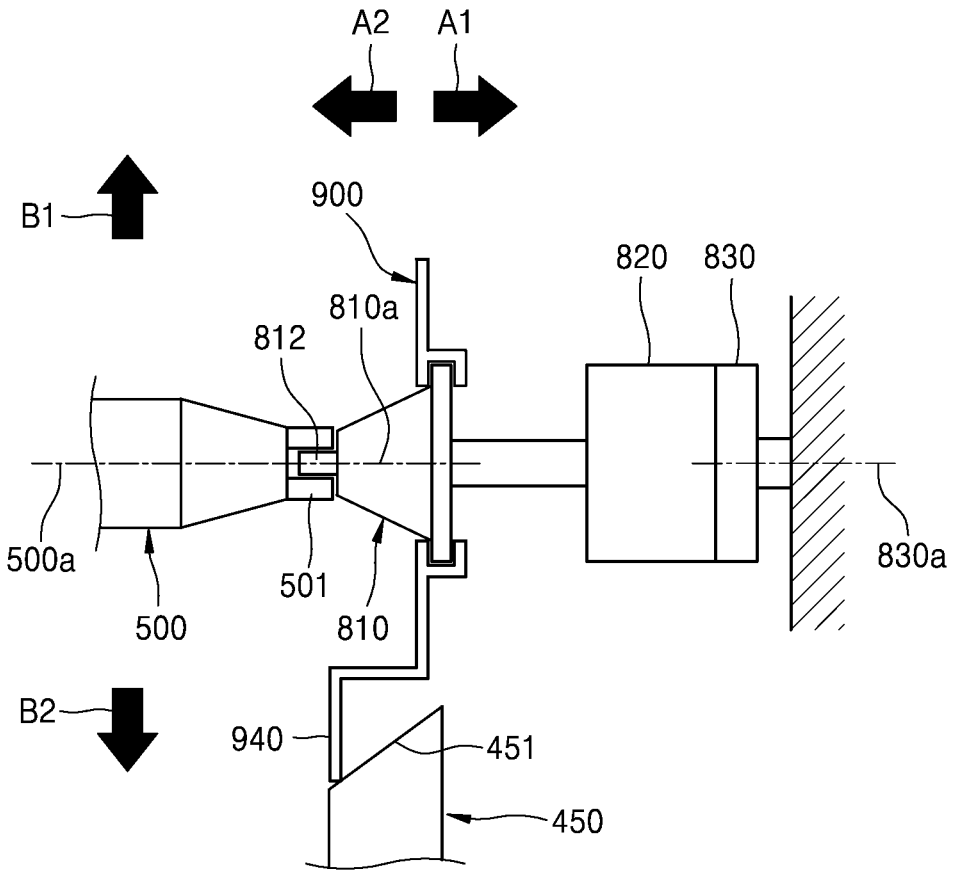

As illustrated in FIG. 13D, when the imaging cartridge 400 is completely attached to the main body 1, the driving member 810 is placed at the second position. The second coupling part 812 of the driving member 810 engages with the first coupling part 501 of the cartridge coupler 500, and thus rotation power may be transmitted from the driving member 810 to the cartridge coupler 500. In addition, the rotation axis 830*a* of the transmission member 830 is aligned with the rotation axis 810*a* of the driving member 810. The expression "the rotation axis 830*a* of the transmission member 830 is aligned with the rotation axis 810*a* of the driving member 810" is not limited to a state in which the rotation axis 830*a* of the transmission member 830 is exactly aligned with the rotation axis 810*a* of the driving member 810 but is also applicable to an almost aligned state and an state in which alignment errors may be compensated for by an Oldham coupler structure.

Detachment of the imaging cartridge 400 from the main body 1 will now be described while sequentially referring to FIGS. 13D, 13C, 13B, and 13A.

In the state illustrated in FIG. 13D, the driving member 810 is placed at the second position. If the imaging cartridge 400 is pulled in the detachment direction B2, the holder 900 is moved in the first direction A1 by the elastic force of the elastic member 900 in a state in which the interference part 940 is in contact with the position switch part 451 as illustrated in FIG. 13C. Then, the second coupling part 812 of the driving member 810 may start to depart from the first coupling part 501 of the cartridge coupler 500. The movement of the holder 900 in the detachment direction B2 is restricted by the first and second guide parts 920, 930, 921, and 931, thereby maintaining the alignment between the rotation axis 810*a* of the driving member 810 and the rotation axis 500*a* of the cartridge coupler 500. The rotation axis 810*a* of the driving member 810 is separated from and misaligned with the rotation axis 830*a* of the transmission member 830 in the detachment direction B2.

As illustrated in FIG. 13B, until the interference part 940 stops to interfere with the position switch part 451, the alignment between the rotation axis 810*a* of the driving member 810 and the rotation axis 500*a* of the cartridge coupler 500 is maintained, and the first and second coupling parts 501 and 812 are separated from each other. The driving member 810 is returned to the first position by the elastic force of the elastic member 990.

If the imaging cartridge 400 is further pulled in the detachment direction B2, the interference between the interference part 940 and the position switch part 451 stops, and as illustrated in FIG. 13A, the driving member 810 is moved together with the transmission member 830 and the connection member 820 in the detachment direction B2. The driving member 810 is maintained at the first position at which the rotation axis 810*a* of the driving member 810 is misaligned with the rotation axis 500*a* of the cartridge coupler 500 by the elastic force of the elastic member 990. In this state, if the imaging cartridge 400 is further pulled in the detachment direction B2, the imaging cartridge 400 may be detached from the main body 1.

In the description of one or more of the previous embodiments, a structure for transmitting power from the main body 1 to rotary members of the imaging cartridge 400 is explained when the developing device 2 has the first structure. The toner cartridge 100 may be individually attached to the main body 1. The combination of the cartridge coupler 500 and the set coupler 50 or the combination of the cartridge coupler 500 and the set coupler 800 may be used to transmit power from the main body 1 to rotary members of the toner cartridge 100 such as the first and second toner supply members 103 and 104.

The combination of the cartridge coupler 500 and the set coupler 50 and the combination of the cartridge coupler 500 and the set coupler 800 may also be applied to the case in which the developing device 2 has the second structure, the third structure, or the fourth structure. For example, the combination of the cartridge coupler 500 and the set coupler 50 and the combination of the cartridge coupler 500 and the set coupler 800 may be applied to the second structure including the photoconductor cartridge 200, the developing cartridge 300, and the toner cartridge 100; the third structure including the photoconductor cartridge 200 and the developing cartridge 300; and the fourth structure (integral cartridge structure).

Figure 14:
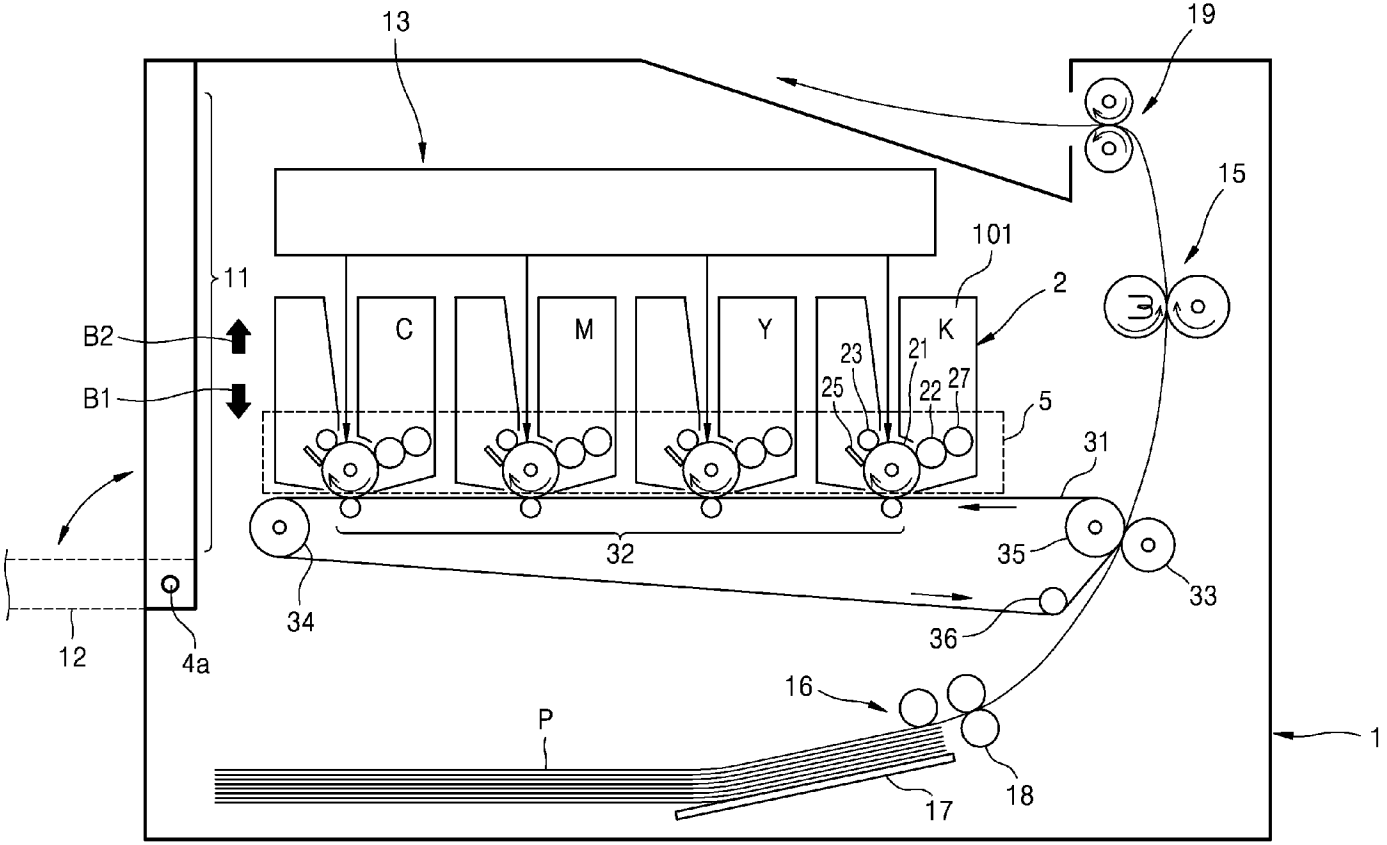
FIG. 14 is a schematic view illustrating an electrophotographic image forming apparatus including integral developing devices having a fourth structure according to an embodiment.

For example, FIG. 14 is a schematic view illustrating an electrophotographic image forming apparatus including integral developing devices 2 having the fourth structure according to an embodiment. The electrophotographic image forming apparatus of the embodiment is configured to print color images on recording media P by an electrophotographic method. Referring to FIG. 14, the electrophotographic image forming apparatus may include the developing devices 2, an exposing device 13, a transfer device, and a fuser 15.

For color printing, the developing devices 2 may include four developing devices 2 capable of developing cyan (C), magenta (M), yellow (Y), and black (K) colors, respectively. Cyan (C), magenta (M), yellow (Y), and black (K) toners may be contained in the four developing devices 2, respectively. Although not illustrated in FIG. 14, cyan (C), magenta (M), yellow (Y), and black (K) toners may be contained in four toner supply containers and may be supplied to the four developing devices 2, respectively. The electrophotographic image forming apparatus may include other developing devices containing toners having different colors such as light magenta or white. The case in which the electrophotographic image forming apparatus includes the four developing devices 2 will now be described. In the following description, unless otherwise specified, reference numerals used together with C, M, Y, and K indicate elements for developing cyan (C), magenta (M), yellow (Y), and black (K) colors.

The developing devices 2 may be integral developing devices having the above-described fourth structure. Each of the developing devices 2 includes a photoconductive drum 21, a developing roller 22, and a toner container 101. In FIGS. 1 and 14, elements denoted with the same reference numerals have the same functions, and thus repeated descriptions thereof will be omitted.

The transfer device may include an intermediate transfer belt 31, primary transfer rollers 32, and a secondary transfer roller 33. Toner images developed on the photoconductive drums 21 of the developing devices 2C, 2M, 2Y, and 2K are temporarily transferred to the intermediate transfer belt 31. The intermediate transfer belt 31 is rotated while being supported by support rollers 34, 35, and 36. The number of the primary transfer rollers 32 is four, and the primary transfer rollers 32 are arranged at positions respectively facing the photoconductive drums 21 of the developing devices 2C, 2M, 2Y, and 2K with the intermediate transfer belt 31 being placed therebetween. A primary transfer bias voltage is applied to the four primary transfer rollers 32 so as to primarily transfer toner images developed on the photoconductive drums 21 to the intermediate transfer belt 31. A corona transfer device or a pin scorotron type transfer device may be used instead of the primary transfer rollers 32. The secondary transfer roller 33 is located at a position facing the intermediate transfer belt 31. A secondary transfer bias voltage is applied to the secondary transfer roller 33 so that toner images primarily transferred to the intermediate transfer belt 31 may be transferred to a recording medium P.

For example, if a printing command is received from a host (not shown), a controller controls the charging roller 23 to charge the photoconductive drums 21 to have a uniformly potential. The exposing device 13 emits four light beams modulated according to color image data toward the photoconductive drums 21 of the developing devices 2C, 2M, 2Y, and 2K, so as to form electrostatic latent images on the photoconductive drums 21. The developing rollers 22 of the developing devices 2C, 2M, 2Y, and 2K respectively supply cyan (C), magenta (M), yellow (Y), and black (K) toners to the photoconductive drums 21 so as to develop the electrostatic latent images into visible toner images. The developed toner images are primarily transferred to the intermediate transfer belt 31. A recording medium P placed on a medium tray 17 is picked up sheet by sheet by a pickup roller 16 toward a transfer nip formed between the secondary transfer roller 33 and the intermediate transfer belt 31. The toner images primarily transferred to the intermediate transfer belt 31 is secondarily transferred to a sheet of the recording medium P by a secondary transfer bias voltage applied to the secondary transfer roller 33. While the sheet of the recording medium P passes through the fuser 15, the toner images are fused on the sheet of the recording medium P by heat and pressure. After the toner images are fused on the sheet of the recording medium P, the sheet of the recording medium P is discharged by discharge rollers 19.

Figure 15:
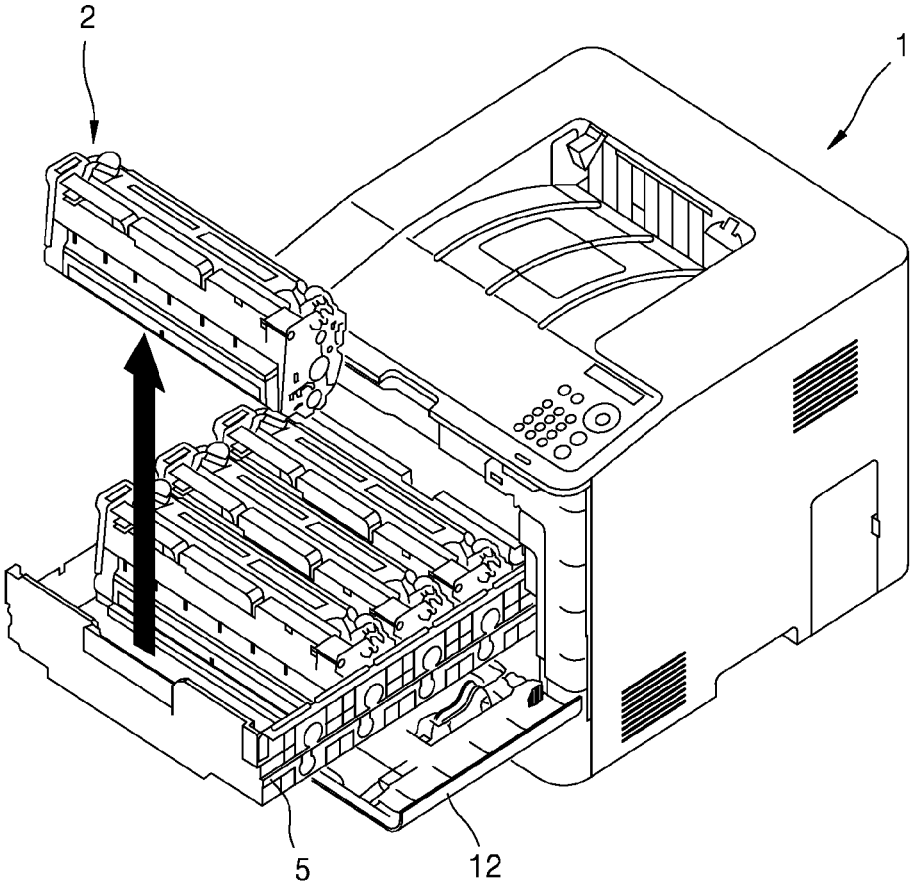
FIG. 15 is a perspective view illustrating an example method of attaching a developing cartridge to a main body.

The integral developing devices 2C, 2M, 2Y, and 2K (that is, developing cartridges 2C, 2M, 2Y, and 2K) may be sequentially installed in a main body 1 through an opening 11 after opening a door 12. Alternatively, the developing cartridges 2C, 2M, 2Y, and 2K may be installed in the main body 1 by a tray method. FIG. 15 is a perspective view illustrating an example in which the developing cartridges 2C, 2M, 2Y, and 2K are installed in the main body 1 by a tray method. Referring to FIG. 15, the main body 1 includes a tray 5. The tray 5 may accommodate the developing cartridges 2C, 2M, 2Y, and 2K and may be inserted into and pulled out from the main body 1. For example, after the door 12 is opened, the tray 5 may be slid out from the main body 1 to place the developing cartridges 2C, 2M, 2Y, and 2K in the tray 5. Thereafter, the tray 5 may be slid into the main body 1, and the door 12 may be closed.

To prevent the photoconductive drums 21 from being damaged by contact with the intermediate transfer belt 31 while the tray 5 is inserted into the main body 1, the photoconductive drums 21 may be maintained at a distance from the intermediate transfer belt 31 until the tray 5 is inserted into the main body 1 and the door 12 is closed. That is, the tray 5 is slid into and out from the main body 1 in a state in which a gap is maintained between the intermediate transfer belt 31 and the photoconductive drums 21. When the tray 5 is inserted into the main body 1 and the door 12 is closed, the tray 5 is moved adjacent to the intermediate transfer belt 31 upon the closing of the door 12, and the photoconductive drums 21 are brought into contact with the intermediate transfer belt 31.

The above-described combination of the cartridge coupler 500 and the set coupler 50 and the combination of the cartridge coupler 500 and the set coupler 800 may also be applied to the electrophotographic image forming apparatus. The attachment and detachment directions B1 and B2 may correspond to lowering and raising directions of the tray 5.

As described above, according to one or more of the above embodiments, the set coupler and the cartridge coupler may be stably connected to each other for transmission of power therebetween.

It should be understood that embodiments described herein should be considered in a descriptive sense only and not for purposes of limitation. Descriptions of features or aspects within each embodiment should typically be considered as available for other similar features or aspects in other embodiments.

Although a few embodiments have been shown and described, it would be appreciated by those skilled in the art that changes may be made in the embodiment without departing from the principles and spirit of the invention, the scope of which is defined in the claims and their equivalents.

What is claimed is:

1. A cartridge detachably attachable to a main body of an image forming apparatus, the cartridge comprising:

a rotary member; and a cartridge coupler comprising a transmission member coupled to a rotation axis of the rotary member, a receiving member connectable with a set coupler in the main body of the image forming apparatus to transmit power therebetween, and a connection member to connect the transmission member and the receiving member to each other, the receiving member being movable relative to the transmission member and the connection member in an axial direction corresponding to a rotation axis of the receiving member, wherein the receiving member is movable to a first position at which the receiving member is in contact with the connection member and the rotation axis of the receiving member is misaligned with a rotation axis of the transmission member in an attachment or a detachment direction of the cartridge perpendicular to the axial direction, and the receiving member is movable to a second position at which the receiving member is spaced apart from the connection member in the axial direction and the rotation axis of the receiving member is aligned with the rotation axis of the transmission member.

2. The cartridge of claim 1, wherein when the receiving member is at the first position, the connection member is in contact with the transmission member and is offset from the transmission member in the attachment direction of the cartridge, and when the receiving member is at the second position, the connection member remains in contact with the transmission member and is not offset from the transmission member in the attachment direction of the cartridge.

3. The cartridge of claim 2, further comprising an elastic member applying elastic force to move the receiving member in a direction toward the first position.

4. The cartridge of claim 3, further comprising a holder supporting the receiving member while allowing rotation of the receiving member, wherein the holder is movable to place the receiving member at the first position or the second position.

5. The cartridge of claim 4, further comprising:

a first guide part provided on the holder; and a second guide part to guide the first guide part to move the receiving member to the first position or the second position.

6. The cartridge of claim 4, wherein the holder comprises an interference part, and when the cartridge is attached to the main body of the image forming apparatus, the interference part interferes with a position switch member provided on the main body of the image forming apparatus so as to move the receiving member from the first position to the second position.

7. The cartridge of claim 1, further comprising a first magnetic member, wherein when the cartridge is attached to the main body of the image forming apparatus, the receiving member is moved from the first position to the second position by magnetic attractive force between the first magnetic member and a second magnetic member provided in the main body of the image forming apparatus.

8. An electrophotographic image forming apparatus, comprising:

a main body;

a set coupler provided in the main body of the electrophotographic image forming apparatus; and a cartridge detachably attachable to the main body of the electrophotographic image forming apparatus, the cartridge including:

a rotary member, and a cartridge coupler comprising a transmission member coupled to a rotation axis of the rotary member, a receiving member connectable with the set coupler provided in the main body of the electrophotographic image forming apparatus to transmit power therebetween, and a connection member to connect the transmission member and the receiving member to each other, the receiving member being movable relative to the transmission member and the connection member in an axial direction corresponding to a rotation axis of the receiving member, wherein when the cartridge is detached from the main body of the electrophotographic image forming apparatus, the receiving member is at a first position such that the receiving member is in contact with the connection member and the rotation axis of the receiving member is misaligned with a rotation axis of the transmission member in an attachment or detachment direction of the cartridge perpendicular to the axial direction, and when the cartridge is attached to the main body of the electrophotographic image forming apparatus, the receiving member is moved in the axial direction to a second position such that the receiving member is spaced apart from the connection member in the axial direction, the rotation axis of the receiving member is aligned with the rotation axis of the transmission member, and the receiving member is connected to the set coupler.

9. The electrophotographic image forming apparatus of claim 8, further comprising an elastic member applying elastic force to move the receiving member in a direction toward the first position.

10. The electrophotographic image forming apparatus of claim 9, further comprising:

a holder supporting the receiving member while allowing rotation of the receiving member, the holder being provided on the cartridge and movable together with the receiving member when the receiving member is moved between the first position and the second position;

an interference part provided on the holder; and a position switch member provided on the main body of the electrophotographic image forming apparatus and to move the holder together with the receiving member when the receiving member is moved from the first position to the second position by interfering with the interference part when the cartridge is attached to the main body of the electrophotographic image forming apparatus.

11. The electrophotographic image forming apparatus of claim 10, wherein when the rotation axis of the receiving member is aligned with a rotation axis of the set coupler while the cartridge is attached to the main body of the electrophotographic image forming apparatus, the interference part and the position switch member start to interfere with each other.

12. The electrophotographic image forming apparatus of claim 10, wherein the position switch member includes a position switch part that is inclined such that when the rotation axis of the receiving member is aligned with a rotation axis of the set coupler, the interference part interferes with a first portion of the position switch part, and when the receiving member is at the second position the rotation axis of the receiving member is aligned with the rotation axis of the set coupler and the rotation axis of the transmission member and the interference part interferes with a second portion of the position switch part, the second portion of the position switch part being further from the first portion of the position switch part in the attachment direction.

13. The electrophotographic image forming apparatus of claim 9, further comprising:

a holder supporting the receiving member while allowing rotation of the receiving member, the holder being provided on the cartridge and movable together with the receiving member when the receiving member is moved between the first position and the second position;

a first magnetic member provided on the holder; and a second magnetic member to move the holder together with the receiving member when the receiving member is moved from the first position to the second position by magnetic attractive force between the first magnetic member and the second magnetic member when the cartridge is attached to the main body of the electrophotographic image forming apparatus.

14. The electrophotographic image forming apparatus of claim 8, further comprising:

a position switch member provided on the main body;

a holder to rotatably support the receiving member and movable in the axial direction; and an interference part that protrudes from the holder in the attachment and detachment directions, wherein when the receiving member is in an intermediary position between the first position and the second position as the receiving member is moved in the axial direction, the interference part interferes with the position switch member, and the rotation axis of the receiving member is aligned with a rotation axis of the set coupler and misaligned with the rotation axis of the transmission member, and when the receiving member is moved from the intermediary position to the second position, the receiving member is moved in the axial direction and in the attachment direction, while the interference part also moves in the attachment direction while interfering with the position switch member.

15. The electrophotographic image forming apparatus of claim 8, wherein the connection member is movable in a radial direction of the transmission member, relative to the transmission member, and perpendicular to the axial direction, and the connection member is not movable relative to the transmission member in the axial direction.

* * * * *